US010557314B2

(12) United States Patent
Haavind

(10) Patent No.: US 10,557,314 B2
(45) Date of Patent: Feb. 11, 2020

(54) RIG FLOOR FOR A DRILLING RIG

(71) Applicant: NATIONAL OILWELL VARCO NORWAY AS, Kristiansand S (NO)

(72) Inventor: Erik Haavind, Kristiansand (NO)

(73) Assignee: National Oilwell Varco Norway AS, Kristiansand S (NO)

( * ) Notice: Subject to any disclaimer, the term of this patent is extended or adjusted under 35 U.S.C. 154(b) by 144 days.

(21) Appl. No.: 15/521,694

(22) PCT Filed: Sep. 22, 2015

(86) PCT No.: PCT/GB2015/052736
§ 371 (c)(1),
(2) Date: Apr. 25, 2017

(87) PCT Pub. No.: WO2016/066986
PCT Pub. Date: May 6, 2016

(65) Prior Publication Data

US 2017/0321490 A1 Nov. 9, 2017

(30) Foreign Application Priority Data

Oct. 30, 2014 (GB) ..... 1419348.6

(51) Int. Cl.
*E21B 15/00* (2006.01)
*E21B 15/02* (2006.01)
*B63B 35/44* (2006.01)

(52) U.S. Cl.
CPC ..... *E21B 15/003* (2013.01); *B63B 35/4413* (2013.01); *E21B 15/02* (2013.01)

(58) Field of Classification Search
CPC .... E21B 15/003; E21B 15/02; B63B 35/4413
See application file for complete search history.

(56) References Cited

U.S. PATENT DOCUMENTS 4,544,135 A * 10/1985 Albaugh ..... B66F 1/08 254/108
4,823,870 A 4/1989 Sorokan
5,259,275 A 11/1993 Schulze-Beckinghausen
5,368,113 A 11/1994 Schulze-Beckinghausen
(Continued)

FOREIGN PATENT DOCUMENTS

GB 2003448 A 3/1979
GB 2139267 A 11/1984
(Continued)

OTHER PUBLICATIONS

UK Search Report dated Feb. 20, 2015 for GB patent application No. GB1419348.6, filed on Oct. 30, 2014.
(Continued)

*Primary Examiner* — Matthew R Buck
(74) *Attorney, Agent, or Firm* — Amerson Law Firm, PLLC

(57) ABSTRACT

A system for moving items on a rig floor (2), the system comprising a plurality of skids (30-35) and a network of rails (10) for guiding the plurality of skids, each skid of said plurality of skids for supporting an item, and each skid having rail engagement members for engaging at least one rail of said network of rails. The rig floor may form part of a drilling rig such as a drill ship (1) used in the construction of oil and gas wells.

33 Claims, 17 Drawing Sheets

(56) References Cited

U.S. PATENT DOCUMENTS

| | | | | |
|---|---|---|---|---|
| 6,082,224 | A | 7/2000 | McDaniels et al. | |
| 6,554,075 | B2 * | 4/2003 | Fikes | E21B 15/003 166/379 |
| 6,871,609 | B2 * | 3/2005 | Roodenburg | B63B 15/00 114/201 R |
| 7,861,619 | B2 | 1/2011 | Stensland | |
| 8,261,674 | B2 * | 9/2012 | Wathne | B63B 27/00 108/54.1 |
| 8,573,334 | B2 * | 11/2013 | Smith | B62D 57/02 180/8.5 |
| 9,051,783 | B2 * | 6/2015 | Croatto | E21B 19/006 |
| 9,731,796 | B2 * | 8/2017 | Chiu | B63B 35/4413 |
| 9,889,908 | B2 * | 2/2018 | Dekker | B63B 27/02 |
| 2005/0047884 | A1 | 3/2005 | Belik | |
| 2012/0181046 | A1 | 7/2012 | Kajaria | |
| 2014/0262504 | A1 | 9/2014 | Seng et al. | |
| 2015/0090464 | A1 * | 4/2015 | Johnston | E21B 19/002 166/385 |

FOREIGN PATENT DOCUMENTS

| | | | |
|---|---|---|---|
| WO | WO1998/016716 | A1 | 4/1998 |
| WO | WO1998/032947 | A1 | 7/1998 |
| WO | 2007/093787 | A1 | 8/2007 |
| WO | 2009093069 | A2 | 7/2009 |
| WO | 2011135541 | A2 | 11/2011 |
| WO | 2014108542 | A2 | 7/2014 |

OTHER PUBLICATIONS

Int'l Search Report and Written Opinion dated Jan. 25, 2016 for PCT/GB2015/052736, dated Sep. 22, 2015.

MacGregor Norway AS: "MacGregor Module Handling Systems", YouTube XP054976304.

* cited by examiner

RIG FLOOR FOR A DRILLING RIG

The present invention relates to a rig floor for a drilling rig, a system for moving items on a rig floor, a method of configuring items on a rig floor of a drilling rig, skids for use on a rig floor and a dog house.

In the drilling of a wellbore, a drill bit is arranged in a bottom hole assembly on the lower end of a drill string. The drill bit is rotated to bore a hole in a formation. The formation may be below water or may be dry land. An upper end of the drill string passes through an opening in a drill floor of a drilling rig. The opening is known as well-centre. The drill string is constructed on a drilling rig and lowered into the hole using a wireline drawn-in and let-out by a winch known as a drawworks. The wireline passes from the drawworks, over a crown block fixed to the top of a derrick, and passes down to a travelling block which travels up and down within the derrick to raise or lower sections of drill pipe and/or the entire drill string.

The drill bit is, at least initially, rotated by rotation of the drill string. The drill string may be rotated by a rotary table arranged at well-centre in the drill floor. In this case, a swivel is hooked on to the travelling block, which has an elevator attached thereto in which the drill string is held for lowering and raising. Alternatively or additionally, the drill string may be rotated by a top drive movable up and down a track in the derrick. The travelling block is connected to the top drive to raise and lower the top drive along the track. A top drive elevator depends from the top drive on bails. The drill string is prevented from falling downhole by wedges arranged in a spider in the rig floor. As the hole is drilled, sections of drill pipe are added to the drill string to allow the drill bit to drill deeper into the formation. The sections of drill pipe are usually added in stands of two or more usually three sections. The stands of drill pipe are made up off well-centre in a mouse hole or powered rat hole. The stands are made up using an iron roughneck or: a separate spinner to run threaded pin ends of a upper section of drill pipe into corresponding threaded boxes of a lower section of drill pipe to make a connection; and a tong to torque the connection. Pipe handling apparatus moves sections of pipe from a pipe rack, store or conveyor into alignment with the mouse hole or rat hole. Another pipe handling apparatus moves the stand of dill pipe into a further pipe rack or directly to well-centre for connection to the drill string. Alternatively, the the stand of drill pipe is conveyed to the well-centre on a conveyor belt and the elevator or top drive elevator is used to lift the upper end of the stand of drill pipe, upon which the lower end swings into alignment with well-centre. A drill pipe tail handler is used to control the free lower end of the drill pipe and align it with well-centre. The stand of drill pipe is then connected to the string of drill pipe suspended in the hole. The connection is made using an iron rough neck or a separate spinner and tongue. The iron roughneck may be supported on an arm, rotatable about a pole so that it is movable between well-centre and the mousehole (US2005/0047884). It has been known to move a power tong on wheels (U.S. Pat. No. 5,259,275), and on a set of rails (U.S. Pat. No. 7,861,619) to and from a well-centre, suspended from a line and swung in (U.S. Pat. No. 6,082,224), and using flexible chains which mesh to form a rigid member to push the suspended tong to and from well-centre (U.S. Pat. No. 5,368,113) and using a telescopic arm (WO 98/32947).

Drilling fluid is pumped down through the drill string to the drill bit and out through openings in or near the drill bit. Drill cuttings are flushed upwardly through an annulus between the drill string and wall of the hole to a flowline on the drilling rig. Solids control equipment such as shale shakers, centrifuges, hydrocyclones, degassers and desanders, are arranged above a series of holding tanks known as an active mud system. The drilling fluid in the active mud system is continuously fed from the flowline, processed continuously, having solids removed therefrom, tested, additives added and returned to the well via a nose neck connection on the top drive or swivel a through the drill string.

To improve the integrity of the hole, the hole may be lined with casing. A string of casing is lowered into the hole and hung from a wellhead or template on the surface of the formation. During construction of the casing string a section of casing is added to the casing string as it is lowered into the hole. Casing is generally of much larger diameter than drill pipe and thus needs a different set of tools on the drill floor. The drill floor is thus cleared of tools used in the drilling operation and replaced with tools for the casing operation. For instance: the iron roughneck is changed out for a casing tong, a roughneck suitable for casing or a casing running tool is attached to the top drive; the drill pipe elevator is changed out with a casing elevator; a drill pipe tail handler is changed out for a casing tail hander; and the spider in changed out or adapted for casing. The section of casing is moved into alignment with a pipe handling apparatus or a casing elevator is used to lift the upper end from a conveyor so that the lower end swings into alignment with well-centre and the casing string suspended in the hole. A casing tail handler receives the lower free end of the casing and lines it up with well-centre. The section of casing is then connected to the string of casing suspended in the hole. The connection is made using the casing tong and associated back-up tong, the roughneck suitable for casing or a casing running tool using rotation of the top drive, whilst torque is resisted by the casing string being held in the casing spider in the rig floor. Once the string of casing is complete, it is hung from the template or wellhead. Centralizers may be used to centre the casing in the hole, which may be fitted to the sections of casing before being conveyed to wellcentre.

The casing may be cemented in place. This is usually carried out in a cementing operation. A cement head is conveyed from where it is set-back in a rack. A bottom wiper plug is pushed along the casing string by cement flowing thereon, separating the cement from drilling mud in the casing string. A top wiper plug follows the predetermined quantity of cement. Upon reaching a shoe of the casing string, a bursting disk bursts in the bottom wiper plug allowing the cement to flow out of the shoe and up into an annulus between the casing and the wall of the hole. The top wiper plug reaches the bottom plug when all of the cement has been injected into the annulus.

A number of Blow Out Preventers (BOPs) may be connected to the template to form a wellhead. In an offshore rig, a riser may not be installed between the wellhead on a seabed and the offshore rig. Installing the BOPs on an offshore rig is carried out from the offshore rig. Typically, the spider is removed and the BOPs or entire wellhead is lowered from a floor beneath the rig floor using a line from the drawworks. The riser is generally large diameter pipe and may have an exoskeleton structure, which are lowered and connected using a similar technique to running drill pipe or casing, but requires specialist tools on the rig floor.

Drilling then continues through the riser and wellhead and thus, the set of tools is changed back to the set used for drilling. When the drill string is long, it is difficult to transfer torque from the top drive or rotary table to the drill bit. A mud motor may be used. The mud motor is installed near to the bottom hole assembly. The circulation of drilling mud through the mud motor rotates the drill bit.

More, smaller diameter casings may be installed and cemented in place as the hole is drilled further. Again, the set of tools used for drilling will be changed out for a set for smaller diameter casing. Furthermore, a liner may be set, which is a casing which is not tied back to the wellhead, but hung from the lower end of a previously hung casing.

Lateral holes may be formed from the main hole, using tools such as window mills and whipstocks. The lateral holes can extend several kilometres from the main hole.

Specialist tools may be required during the drilling process, such as a continuous circulation tool, such as the one shown in WO-98/16716 and WO 2009/093069. These tools are brought up to the rig floor and placed at well-centre. The continuous circulation tool is then connected into the drill string between the rig floor and an upper sub connected to a top drive. These tools allow a continuous circulation of drilling mud whilst dill pipe is added or taken away during tripping and thus maintains a constant pressure in the wellbore.

Once the wellbore is long and deep enough and judged to be in the correct place for production, the well undergoes a completion phase. This may involve setting perforate pipe. Furthermore, the hole may then be cleaned using cleaning tools on the end of a drill string and made ready for receiving oil from the formation. In some circumstances, explosives may be sent down the well bore to induce flow of oil, which involves using a number of specialist pieces of equipment on the rig floor at well-centre. The well then enters the production phase.

Various operations can be carried out during the production phase, such as work over and well stimulation operations to attempt to obtain more oil from the well. These operations may be carried out using coiled tubing and tools connected thereto. These operations may be carried out from the well head or the rig floor. Thus a reel of coiled tubing is needed and a diverter tool to facilitate passage of the coiled tubing into cased the wellbore.

Thus the drill string may be tripped-in and tripped-out frequently between these operations.

The inventors have observed that there is significant "flat time" in setting up the rig floor for various rig operations such as drilling, casing, completion, production, well intervention and stimulation. Furthermore, the inventors have observed that there is significant flat time in setting up the rig floor for specialist procedures, such as using continuous circulation, cementing, retrieving stuck tools, installing BOPs, installing risers, casing, completion operations etc. This is particularly, but not exclusively relevant in a dual derrick system, where operations switch from drilling, to casing to completion etc. very quickly and frequently, thus a lot of time is lost as "flat time", whilst changing the configuration of tools at one of the well-centres, work at the other of the well-centres may have to cease.

The inventors have also observed that if a tool used on a rig floor becomes faulty, the rig operations have to cease whilst men retrieve and replace the faulty tool. Significant down time can occur.

In accordance with the present invention, there is provided a system for moving items on a rig floor, the system comprising a plurality of skids and a network of rails for guiding the plurality of skids, each skid of said plurality of skids for supporting an item, and each skid having rail engagement members for engaging at least one rail of said network of rails.

The present invention also provides a system for moving items on a rig floor, the system comprising a plurality of accommodation means and a network of guiding means for guiding the plurality of accommodation means, each accommodation means of said plurality of accommodation means for supporting an item, and each accommodation means having guiding means engagement members for engaging at least one guiding means of said network of guiding means. The accommodation means may accommodate any tool or item which needs to be moved around a rig floor and particularly, but not exclusively, to and from well centre and may be between well centre and one of a plurality of sidings.

The present invention also provides a method of configuring items on a rig floor, wherein a plurality of skids and a network of rails for guiding the plurality of skids is provided, each skid having rail engagement members for engaging at least one rail of said network of rails, the method comprising the steps of moving an item on a skid of said plurality of skids about at least part of the rig floor.

The present invention also provides a rig floor having a network of rails and a plurality of skids, each skid of said plurality of skids supporting an item and each of said plurality of skids having rail engagement members. Each skid may include structure, such as steel, aluminium, composite or plastic arms, baskets, steps, rests, shelves or frames to carry a specific item. Each skid may travel along all of the network of rails, although each skid may only use a part of the network of rails. A part of the network of rails close to well centre may see the most use. The network of rails may include a plurality of sidings for permanent or temporary storage of a particular skid.

The present invention also provides a rig floor having a plurality of skids and a network of rails for guiding the plurality of skids, each skid of said plurality of skids for supporting an item, and each skid having rail engagement members for engaging at least one rail of said network of rails.

Thus items such as well tools and equipment does not have one dedicated fixed position but is positioned where it is most efficient for the next operation. Where the driller changes-out tools on the rig floor, the tools can be positioned ready for the next operation the driller is about to perform.

Optionally, the skid is self-propelled. Optionally, at least one of the plurality of skids comprises a propulsion unit for propelling the skid along the network of rails. The propulsion unit may be hydraulic and powered by a source of hydraulic power located on the rig, distant to the skid or the skid may include a hydraulic compressor. Optionally, the propulsion unit may further comprise a source of power may be a battery located on the skid or on the rig or distant to the skid to power the hydraulic compressor. Optionally, the propulsion unit comprises a cycling foot. Optionally, the foot is used to selectively push or pull the skid along the network of rails. Optionally, the cycling foot comprises a grabbing mechanism which selectively grabs and releases a rail of the network of rails. Optionally, the cycling foot comprises a leg having at least one articulated joint. Optionally, the cycling foot is driven hydraulically. Optionally, each skid is provided with two cycling feet, optionally one to operate in a first direction and the other to operate in a perpendicular direction, taken in a plane coincident with the network of rails. Optionally, the skid has a trailing hydraulic line attached thereto for powering the propulsion unit. Optionally, the skid is provided with a reel of hydraulic hose. Optionally, the rig floor comprises a plurality of hook-up hydraulic supply points within said network of rails. Optionally, the hydraulic hose has one end provided with a connector, the skid comprising a movable means, such as a ram, spring or articulated arm for pushing the connector into one of said hydraulic hook-up supply points. Optionally, the cycling foot engages the floor and reacts thereagainst to push the skid along the at least one rail. Optionally, the rail has a wide top, sufficient to allow the cycling foot to engage to push the skid therealong. Optionally, the rail has an I-shape cross-section.

Optionally, the network of rails is arranged in a grid, forming a grid of rails. Optionally, the network of rails comprises a pair of parallel rails on which said plurality of skids are guided. Optionally, floor sections are arranged within the area defined by the grid of rails. Optionally, the floor sections are removable. Optionally, the floor sections are fixed. Most optionally, the floor sections are suitable for rig hands to walk on.

Optionally, the network of rails comprises an intersecting warp rail and a weft rail. Optionally, there is a gap in the warp rail and a gap in the weft rail at said intersection. Optionally, at least one rail engagement member comprises a shoe having a skirt portion defining a longitudinal channel. Optionally, the skirt portion further defines a transverse channel. Optionally, the skirt portion comprises a hook portion to hook around at least portion of the rail. Optionally, the warp rail and weft rail intersect at right angles, although may intersect at other angles between 10 and 80 degrees or between 25 and 65 degrees. Optionally, the shoes are skidable shoes. Optionally, the skidable shoe has a low skin friction lining element to facilitate the skid being pushed or pulled. Optionally, each skid is provided with four such shoes. Optionally, the skid is substantially square, optionally having a shoe at or near each corner.

Optionally, the at least one rail supports the skid. Most optionally, the weight of the skid and the item on the skid is taken substantially or entirely by the at least one rail or between a pair of rails. Alternatively, the entire weight or a part of weight of the skid is taken by the rig floor and the rail used for guiding the skid.

Optionally, the rails are located in said rig floor, optionally, so that the rails are substantially in the same plane as the rig floor. This may reduce the chance of a rig hand tripping over a rail. This may reduce the impact of damage and weathering to the rail, as the rail will be substantially protected or enclosed on a bottom face and side faces.

Optionally, the network of rails further comprises at least one predetermined parking spot. Optionally, the predetermined parking spot comprises a physical means for actuable upon reaching said parking spot to provide a physical indication that the skid is parked. Optionally, the rig floor having one of a locating pin and locating hole at a predetermined parking point and at least one of the skids has the other of the locating pin and locating hole, such that in use, one of the locating pin and locating hole is moved to locate the locating pin in the locating hole. The locating pin may be a spring loaded dog and in place of a hole, a raised tooth is provided on the rig floor, such that the spring loaded dog locks on to the raised tooth when the skid moves into the parking spot. Optionally, a parking sensor, such as am ID tag reader is provided to send a signal to a master control system to indicate that the skid is parked at said predetermined parking spot. Optionally, the rig floor adjacent the locating hole is provided with an ID tag which is read by the ID tag reader on the skid. Alternatively, the ID tag is on the skid and the ID tag reader is in the rig floor at the parking spot. Such an ID and ID reader may be: an RFID and RFID reader; an optical system could be used, such as a barcode and bar code reader or a QR code and a QR code reader; or an identification tag using high or low frequencies could be used with associated high and low frequency readers. The identification tags may be powered or energized passively. Optionally, a predetermined parking spot is located at at least one of the following locations: at well-centre for placing item skids such as tool skids at well-centre, which may or may not retain the skid whilst the tool or item is being use; immediately adjacent well-centre for off-loading items form the skid to well-centre; close to well-centre for facilitating off-loading of other item using a crane skid, or for pipe, casing and riser handling tools or for pipe, casing and riser connection tools such as an iron roughneck; on a skid elevator; in a storage area. The master control system is sent a package of information from a parking control processor located on the skid. The parking control processor may be part of a skid control computer. The package of information comprises at least one of the following pieces of information: an identifier code, identifying the type of skid, such as diverter skid or spider skid; whether the item, such as the spider and diverter is on the skid; information about the item, such as size, type, previous working history, current faults and previous faults; the skids orientation; and information locating the parking spot the skid is parked at.

The identifier code, identifying the type of skid, such as diverter skid or spider skid is optionally pre-programmed into the parking control computer.

Information relating to the item, such as the spider and diverter is on or off the skid; information about the item, such as size, type, previous working history, current faults and previous faults is optionally obtained by having an RFID tag reader on the skid and at least one RFID tag and optionally a reserve RFID tag on the item containing information about the item, such as size, type, previous working history, current faults and previous faults.

The master computer control system receives such information packages for all skids on the network of rails. The master computer control system is programmed with information about the layout of tools and equipment for various standard operations, such as: drilling; tripping-in; tripping-out; running casing; cementing casing; completion; and workover. The master control system is then able to control all of the skids using the information packages. The driller or tool pusher is provided with an interface to the master control system in the dog house, such as a window on a touch screen. The driller is offered a list of buttons, each button for an operation, such as drilling; tripping-in; tripping-out; running casing; cementing casing; completion; and workover. The driller presses the button he requires, such as "drilling" and the master control computer system will send signals to the skids to control each skid to move out of and into predetermined parking positions on the rig floor for carrying out drilling. For example, for drilling: the well-centre will need to be cleared; a spider suitable for drill pipe will be needed at well-centre and a crane skid for moving the spider into well-centre; the crane will need to be removed to the storage area; an iron roughneck skid will be need at a predetermined parking spot near well-centre; a pipe tail handling arm skid will be need at a predetermined parking spot near well-centre.

Optionally, the rig floor comprises one of a locating pin and locating hole at a predetermined point and at least one of the skids has the other of the locating pin and locating hole, such that in use, one of the locating pin and locating hole is moved to locate the locating pin in the locating hole. Once the locating pin has entered the locating hole, the exact location of the skid is known and thus a tool on the skid, such as an iron roughneck skid can operate from a predetermined position.

Optionally, the network of rails comprises at least one of and optionally a plurality of each of a: T-junction; intersection; and corner. Optionally, the rails are all straight, linear. Optionally, the rails are curved in a horizontal plane to form bends.

Optionally, the network of rails comprises a vertically movable section of rail. Optionally, the vertically movable section of rail is sized to allow a skid to move between the rig floor and a level therebelow or thereabove. Optionally, a lift floor section is arranged between or about said rail.

Optionally, the rig floor is located in an onshore or offshore drilling rig. Optionally, the rig floor is located in one of: a drill ship; FPSO; offshore platform, such as SPAR platform, SWATH, sea star platform and tensioned leg platform; and land rig.

The present invention also provides a skid for use on the rig floor of the invention, the skid comprising a base, a propulsion mechanism and a shoe for engaging a rail.

Optionally, the skid also comprises a reel of hydraulic hose thereon. Optionally, the reel has an automatic rewind system such that the hydraulic hose remains in tension between the reel and the hook-up point.

Optionally, the skid also comprises a reel of electric cable thereon. Optionally, the reel has an automatic rewind system such that the electric cable remains in tension between the reel and the hook-up point. Optionally, the skid is self-propelled with an electric motor and the electric cable carries sufficient current to power said electric motor. Optionally, the electric motor and electric connections used between the electric cable and the electric motor are explosion proof or arranged in explosion proof enclosures suitable for use on rig floors.

Optionally, the skid is levitated using a magnetic field and a thrust component induced by the magnetic field or by a separate drive means, such as an electric motor driving a wheel along the rig floor or along the rail.

Each skid, such as a coiled tubing skid, pipe handling arm skid, iron roughneck skid, riser handling arm skid and dog house skid is optionally provided with at least one of: a self-propelling system; parking system; automatic hook-up system; and automatic control system. Optionally, the propulsion system is powered hydraulically and hydraulic power and communication lines for the powering rotation of the drum is provided through an auxiliary line on the skid, which branches from the combined hydraulic fluid supply hose and communication lines, thus an additional hook-up is not required.

The dog house is a cabin with a large window in which the driller and tool pusher sit to control the drilling rig. The inventor observed that it is beneficial to have the dog house close to the well-centre so that the driller and tool pusher can see exactly what is happening at well-centre. However, having the dog house very close to well-centre takes up valuable rig space at well-centre, such that the dog house can be close to well-centre during certain operations, but has to be further away during other operations. Furthermore, if anything is going to go wrong on a drilling rig, it is likely to happen at well-centre, especially during certain operations.

According to a second aspect of the invention, there is provided a drilling rig comprising a rig floor and a dog house, wherein said dog house comprises a moveable means for moving about the rig floor. Optionally, said dog house is arranged on a skid. Optionally, the skid is provided with propelling means to propel said dog house around the rig floor. Optionally, said rig floor is provided with a network of rails, wherein said rig floor is movable along said network of rails.

With a fully automated system of the present invention, it is possible to change out tools and other items and equipment, such as hoisting equipment, which have broken or failed and taken back to the workshop and replaced without having rig hands on the rig floor and thus no need to shut down the entire rig floor, which is especially, but not exclusively important with a dual derrick system.

For a better understanding of the present invention, reference will now be made, by way of example, to the accompanying drawings, in which.

Figure 1:
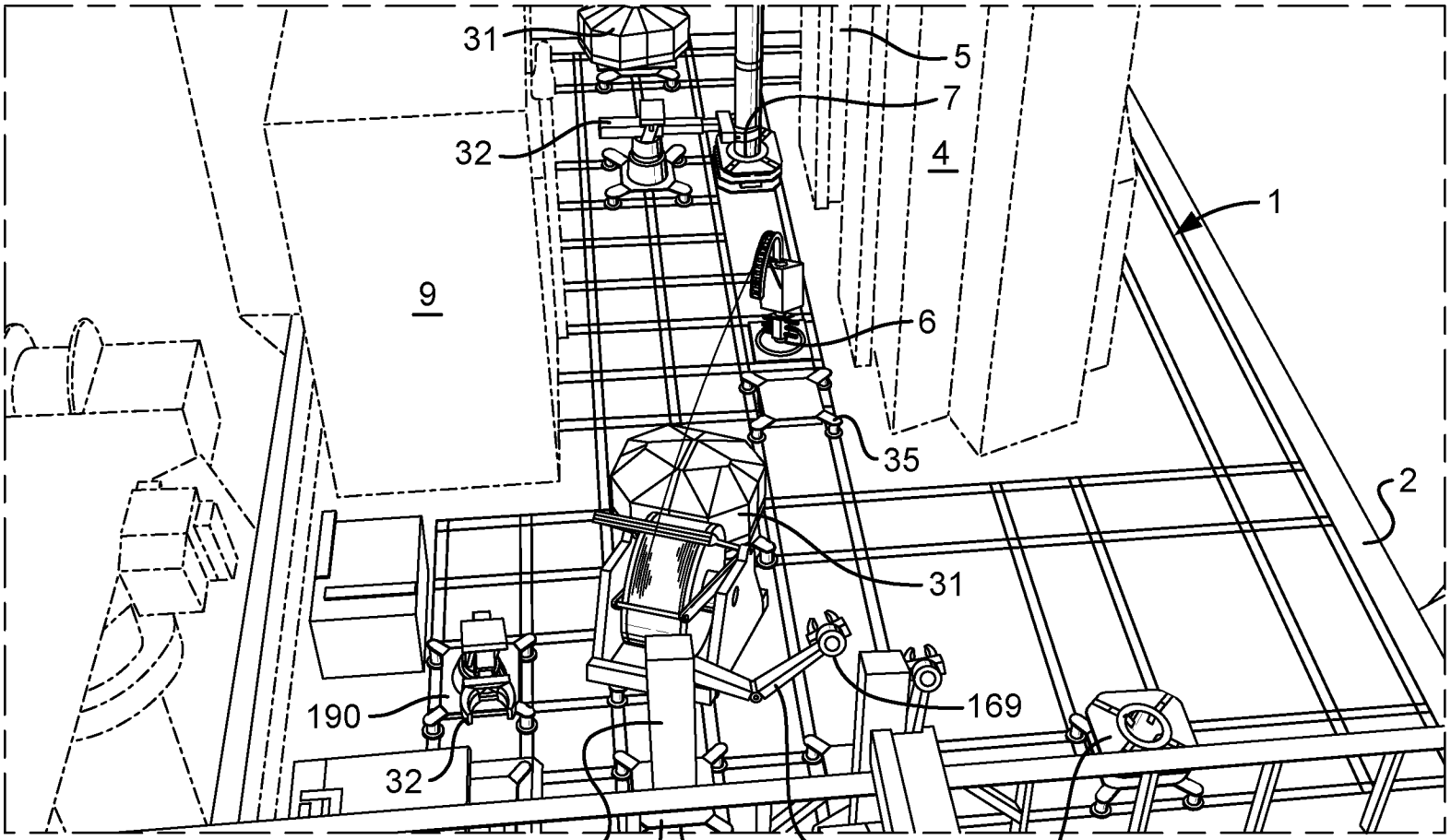
FIG. 1 is a perspective view of part of a drill ship having a rig floor in accordance with the present invention.

Referring to FIGS. 1 to 4, there is shown part of the drill ship, generally identified by reference numeral 1 having a rig floor 2 in accordance with the present invention. The perspective view is taken from aft the drill ship 1 of amidships looking towards the bow 3. The drill ship 1 has two derricks 4 and 5 arranged on a starboard side of the drill ship 1, each with a corresponding well-centre 6 and 7 located substantially along a centreline 8 of the drill ship 1. A pipe handling and make-up structure 9 is arranged on a port side of the drill ship 1. The rig floor 2 is arranged between and about the two derricks 4 and 5. The rig floor 2 surrounds the two derricks 4 and 5. A network of rails 10 is arranged in the rig floor 2. The network of rails 10 comprise a plurality of straight tracks 11 to 19. Each of tracks 11 to 19 comprises a plurality of pairs of rails, such as pairs of rails 20, 21.

Figure 2:
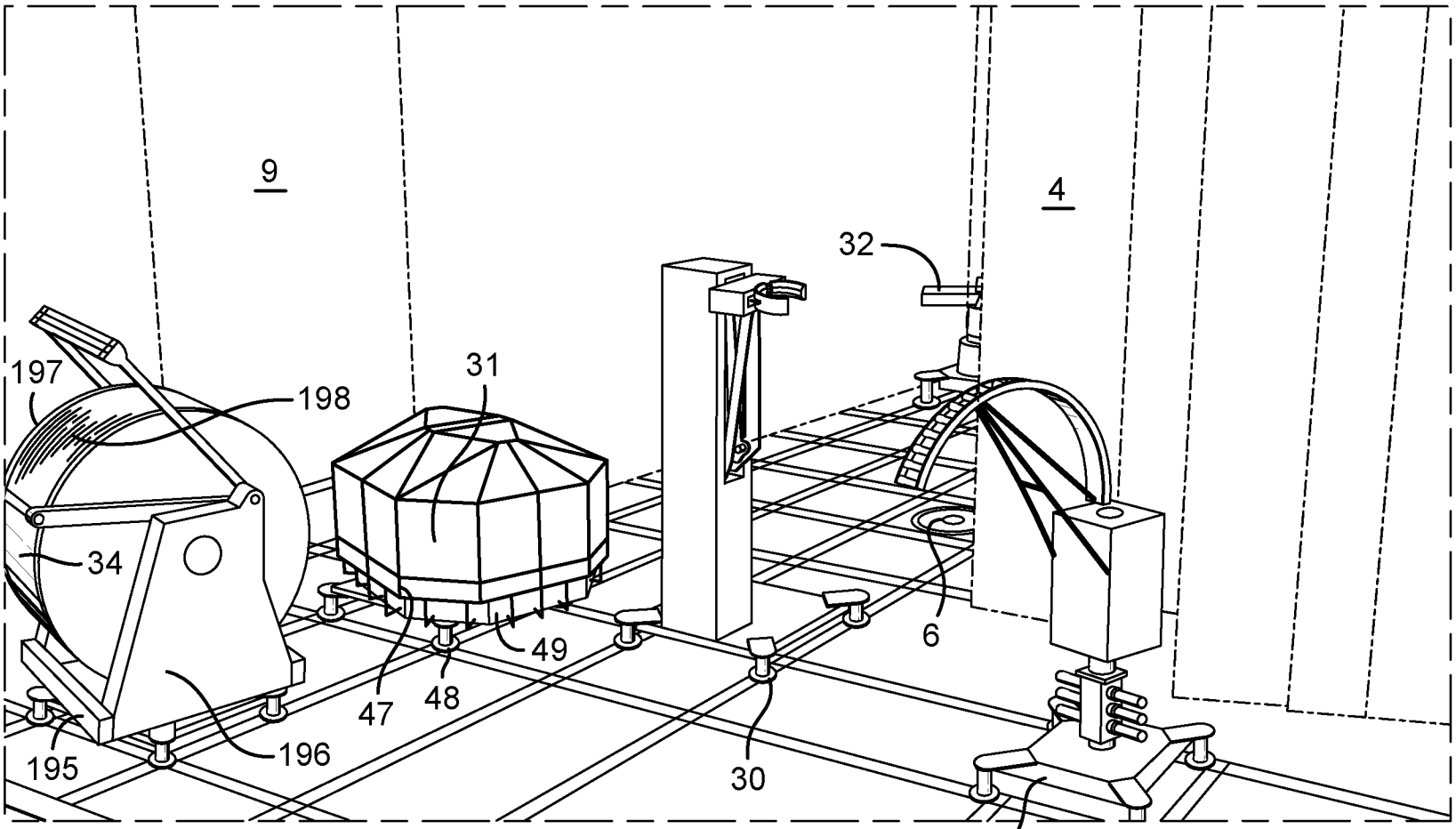
FIG. 2 is a perspective view of the rig floor shown in FIG. 1, in a further step of operation.
Figure 3:
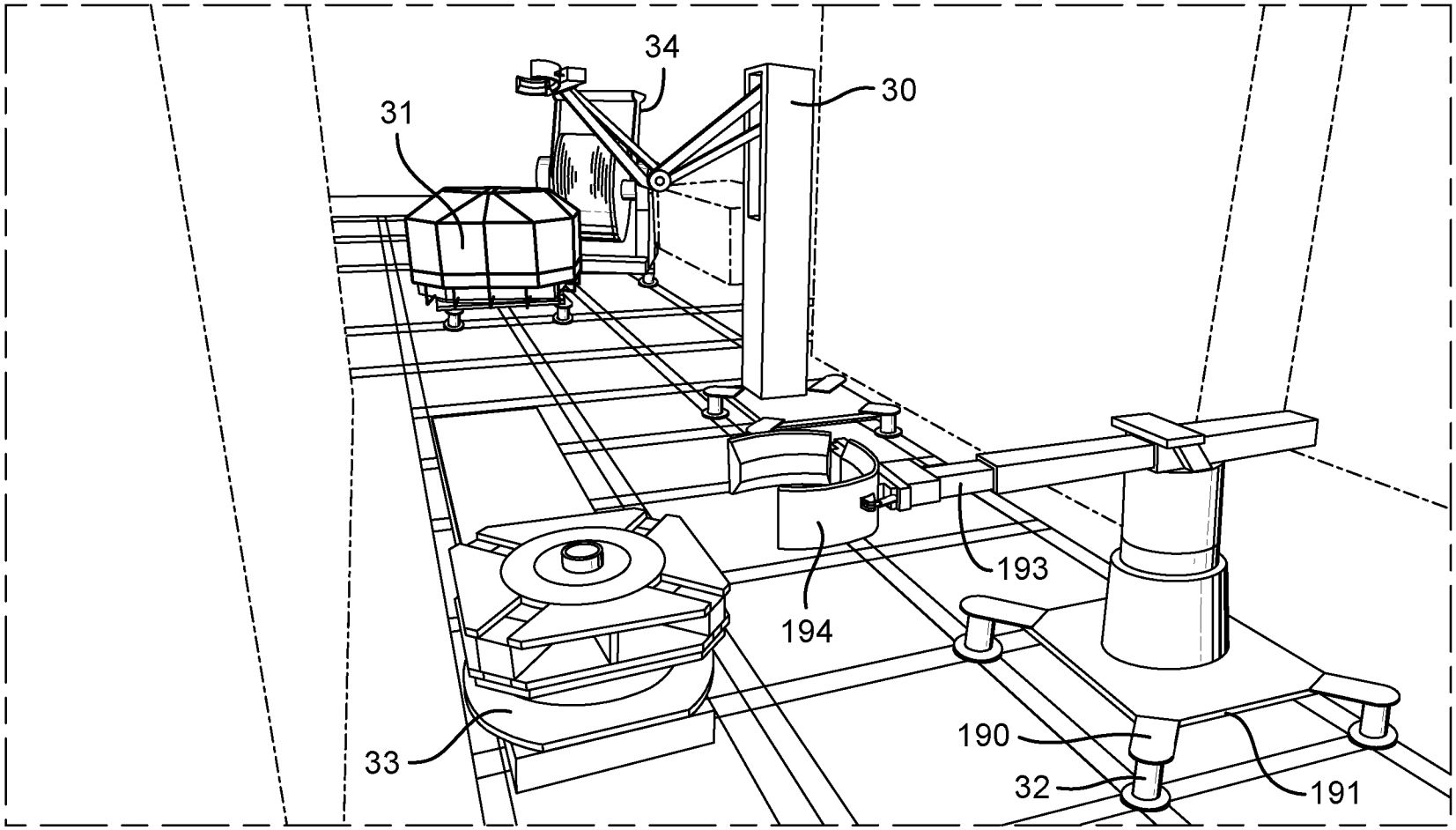
FIG. 3 is a perspective view of the rig floor shown in FIG. 1, in a yet further step of operation.

A plurality of specific item skids of the invention are shown in FIGS. 1 to 3 on the network of rails 10. A pipe tail handler skid 30, a dog house skid 31, a riser handling arm skid 32, a rotary table skid 33, a coiled tubing skid 34 and a well intervention coiled tubing injector skid 35.

The network of rails 10 comprises track 11 to 19 in a layout which will be suitable for a rig floor on a drill ship 1. All tracks 11 to 19 may be used to route particular skids between destinations. However, each track 11 to 19 has a main use.

Tracks 11 and 12 lead around the back of the derricks 4 and 5 and past a downhole tool storage area 22 are used to move particular skids from a bow storage area 23 of the drill ship 1 to the main rig floor 2.

Track 13 is used mainly as a storage area 40 for item skids which may be used in an upcoming operation.

Track 14 is used mainly as an access route to guide skids from the storage area 40 to or close to well-centres 6 and 7. Track 14 also leads to a Christmas Tree elevator 44 located on the port side of the rig floor 2. Christmas Trees 45 are located in an area below the rig floor 2 on a Christmas Tree skid 46.

Track 15 is used mainly as an access route to guide skids from the bow storage area 23 to or close to the well-centres 6 and 7. Tracks 14 and 15 are also used for locating a dog house skid 31, which provide the driller and tool pusher good views of the well-centres 6 and 7.

Track 16 is used mainly as an access route to guide skids from the storage area 40 and the bow storage area 23 to and over the well-centres 6 and 7. Well-centres 6 and 7 are located within a pair of rails 24 and 25 which make up Track 16. Such item skids which will be required at well-centre comprise: spider skid 37, diverter skid 38, BOP test stump skid 39, a Continuous Circulation System skid (not shown) and a rotary table skid 33.

Figure 11:
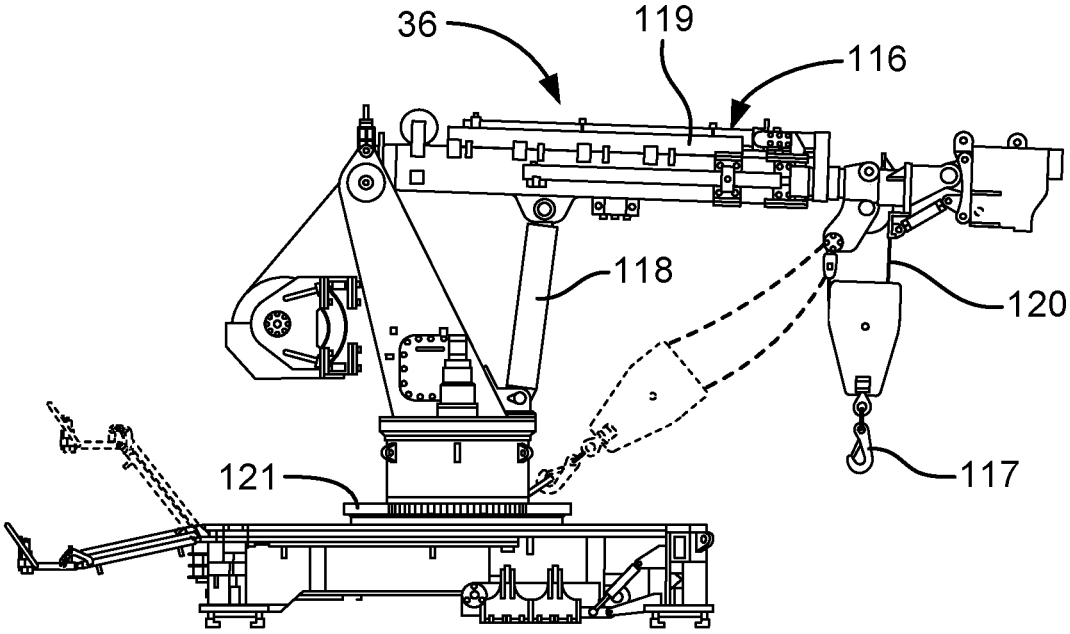
FIG. 11 is a side view of a crane skid with a crane thereon in a first step of operation.
Figure 12:
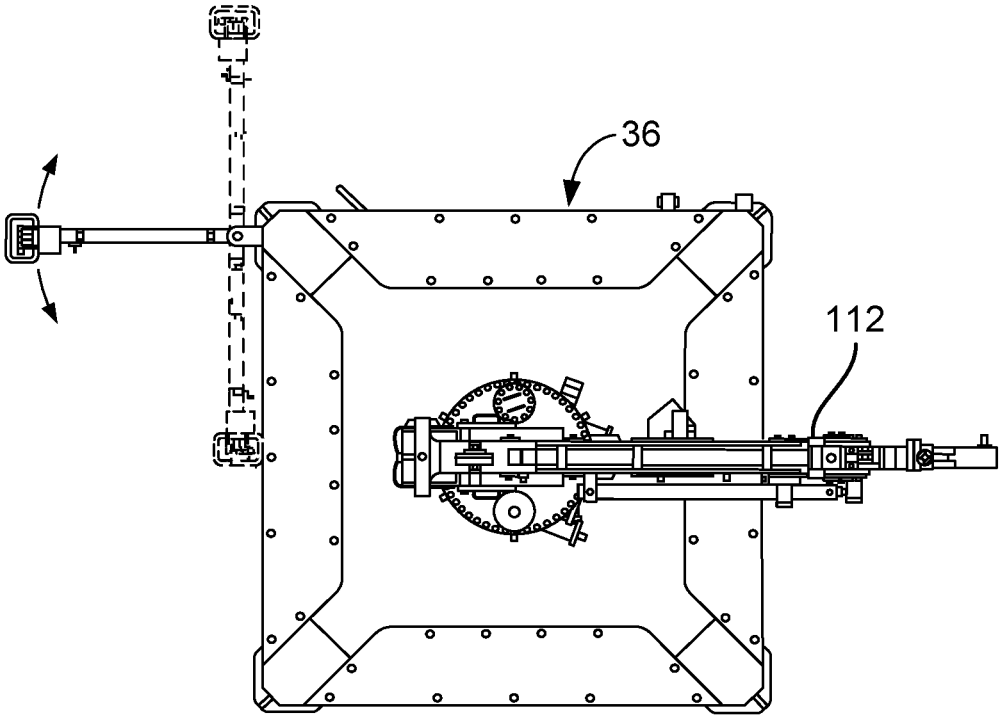
FIG. 12 is a top plan view of the crane skid shown in FIG. 11 with the crane in the first step of operation.
Figure 13:
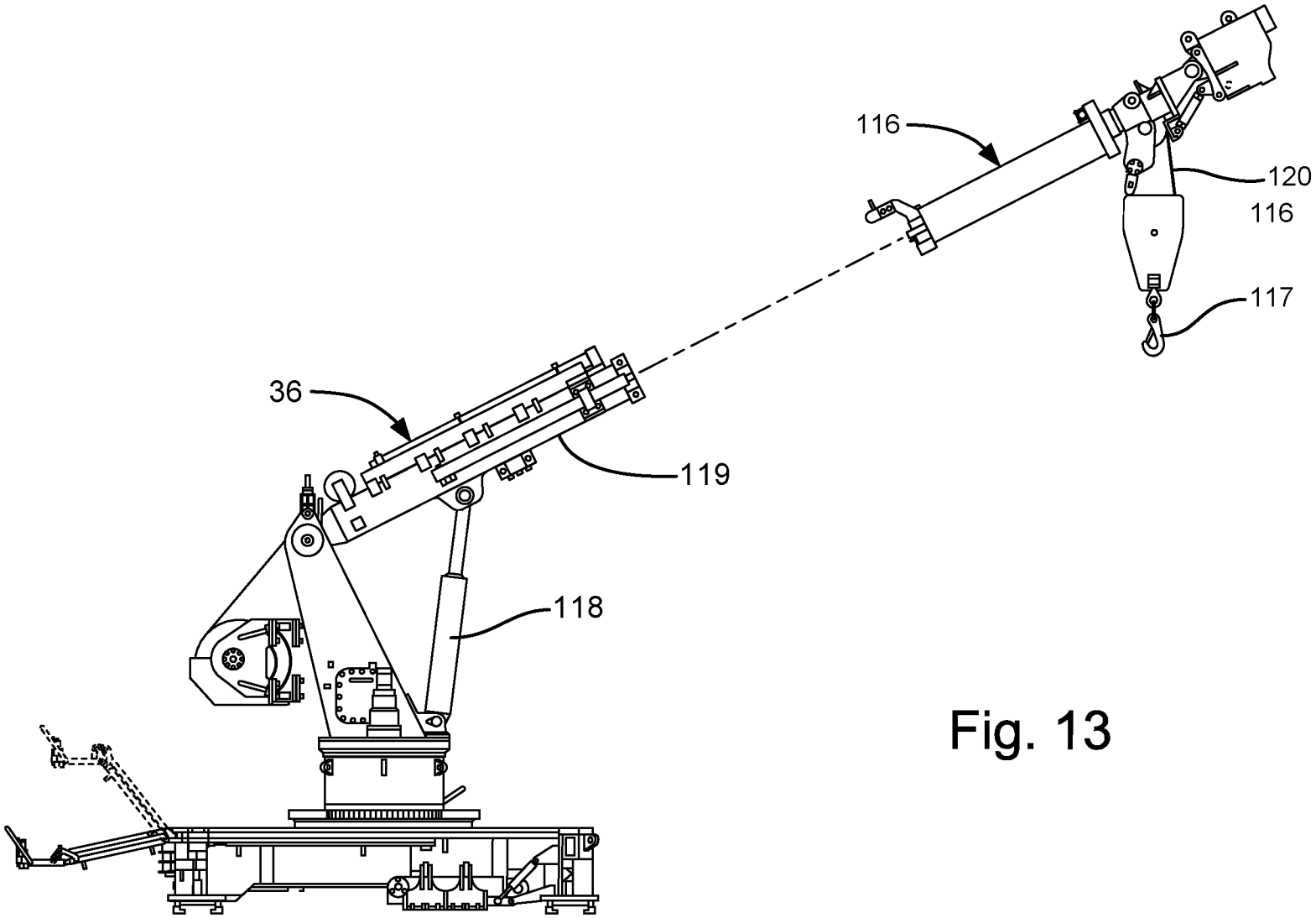
FIG. 13 is a side view of the crane skid with the crane in a second step of operation.

Track 17 is used mainly as an access route to get specific item skids close to the well-centres 6 and 7, wherein the specific item skids will generally remain on the skids on Track 17 while the item is operated, such as: a pipe tail handler skid 30; an iron roughneck skid (not shown); a casing tong skid (not shown); a crane skid 36 (shown in FIGS. 11 to 13).

Track 18 and 19 are used to route the item skids to a skid elevator 41. The skid elevator 41 lifts and lowers item skids between the rig floor 2 and a workshop floor 42. Items and item skids to be repaired and maintained will be moved along the tracks 18 and 19 to the skid elevator 41 and lowered to the workshop level which has its own network of rails 43 to move the item skids to an area of the workshop floor 42 suitable for repairing and maintaining that particular item skid.

Figure 4:
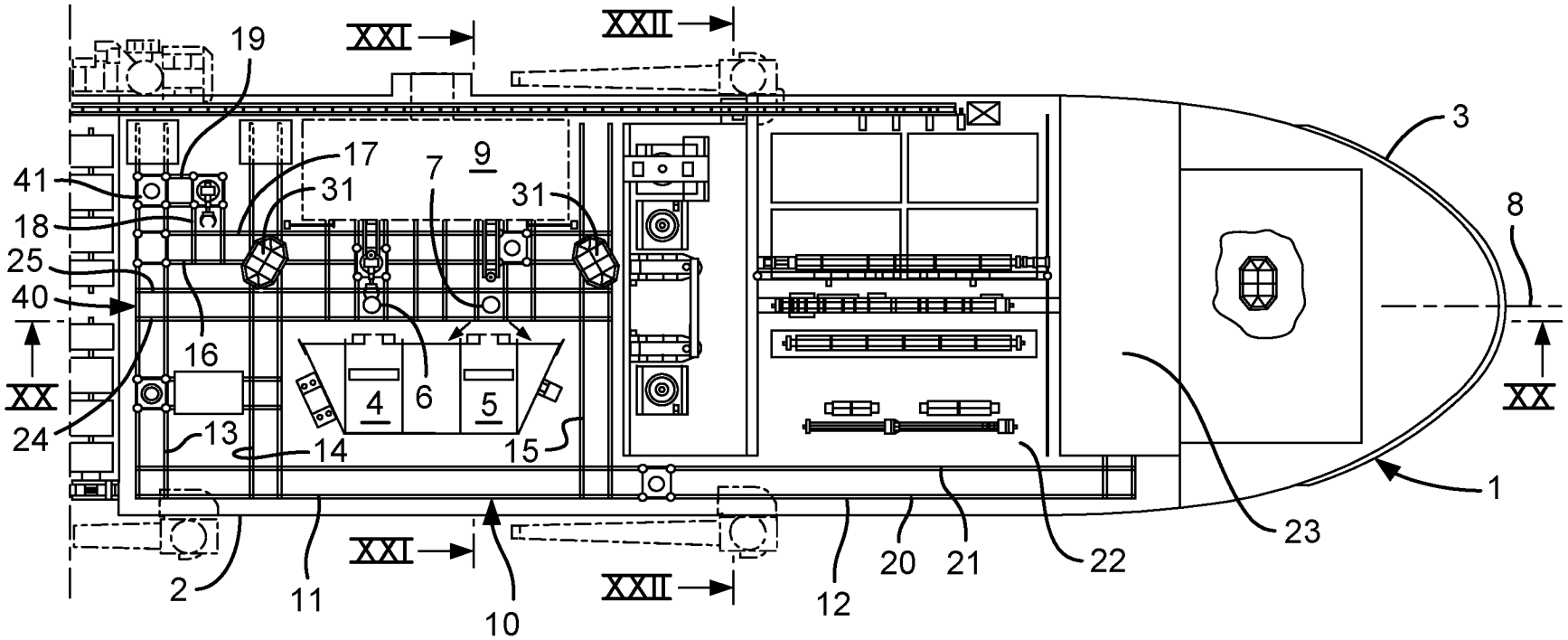
FIG. 4 is a schematic top plan view of part of the drill ship shown in FIG. 1, showing inter alia a network of rails and plurality of skids in accordance with the present invention.
Figure 4A:
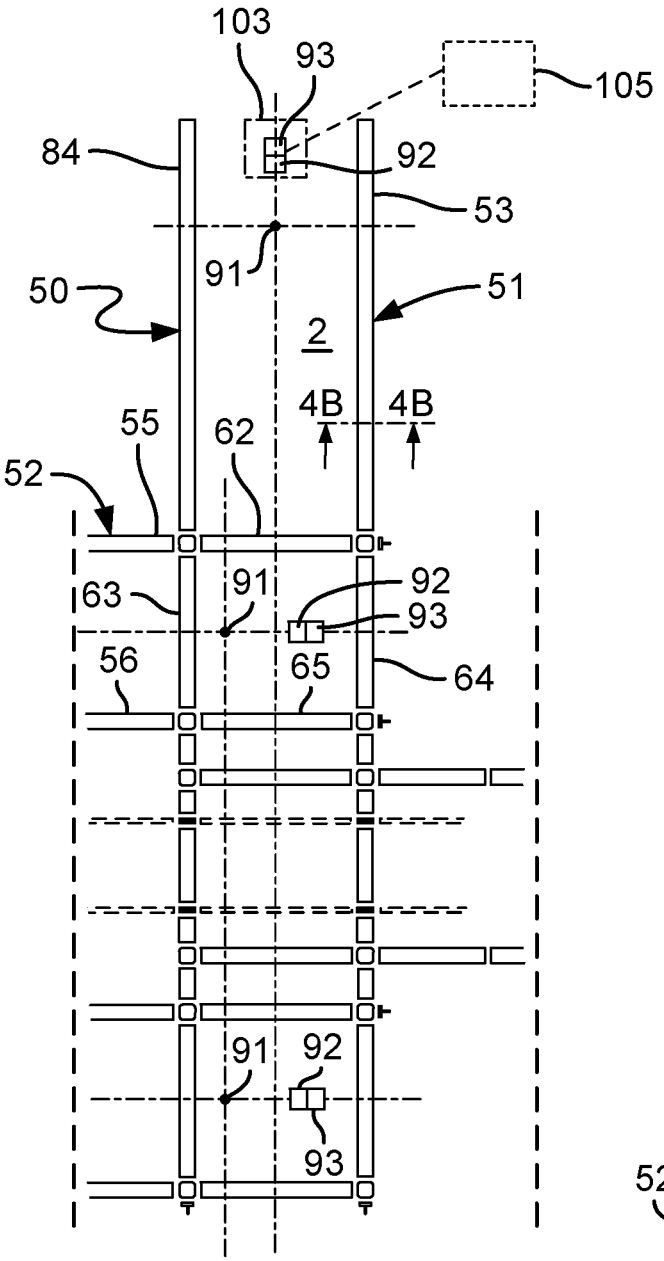
FIG. 4A is a schematic top plan enlarged view of part of the rig floor showing inter alia a network of rails shown in FIG. 4.
Figure 4B:
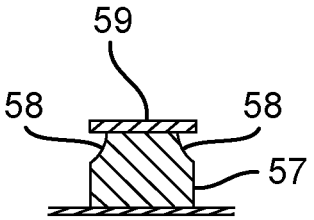
FIG. 4B is a cross-sectional view taken along line 4B-4B of a rail shown in FIG. 4A of the network of rails of the rig floor.

A detail 50 of the network of rails 10 is shown in FIG. 4A. There is shown a warp track 51 intersecting a weft track 52. The warp and weft track 51 and 52 each comprise a pair of parallel rails 53, 54 and 55, 56. A cross-section of the rail 53 is shown in FIG. 4B. The rail 52 to 56 has a weight bearing body 57, curved shoulders 58 and a top 59 extending over the shoulders 58. The pairs of parallel rails 53, 54 and 55, 56 are spaced optionally 3.2 m apart between centre lines of the rails. Where the pair of parallel rails 53, 54 and 55, 56 intersect, the tops 59 of the rails stop short of touching one another, leaving a gap of approximately 75 mm therebetween which is sufficient to allow a shoe 60 (see FIG. 5) to slide between the warp and weft tracks 51 and 52. An island rail top 61 is provided to give support to the shoe 60 when a skid is crossing the intersection. Width rail tops 62, 65 and 63, 64 are provided between the parallel rails of the warp and weft track 51, 52 respectively.

Figure 4C:
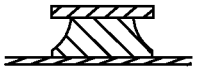
FIG. 4C is a cross-sectional view of a rail of the network of rails for use on the work shop floor.
Figure 4D:
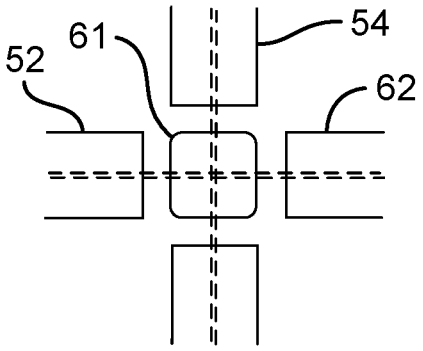
FIG. 4D is a top plan enlarged view of a warp rail intersecting a weft rail.

FIG. 4C shows a cross-section of a rail used on the workshop floor 42, which has a slightly lower profile.

Figure 5:
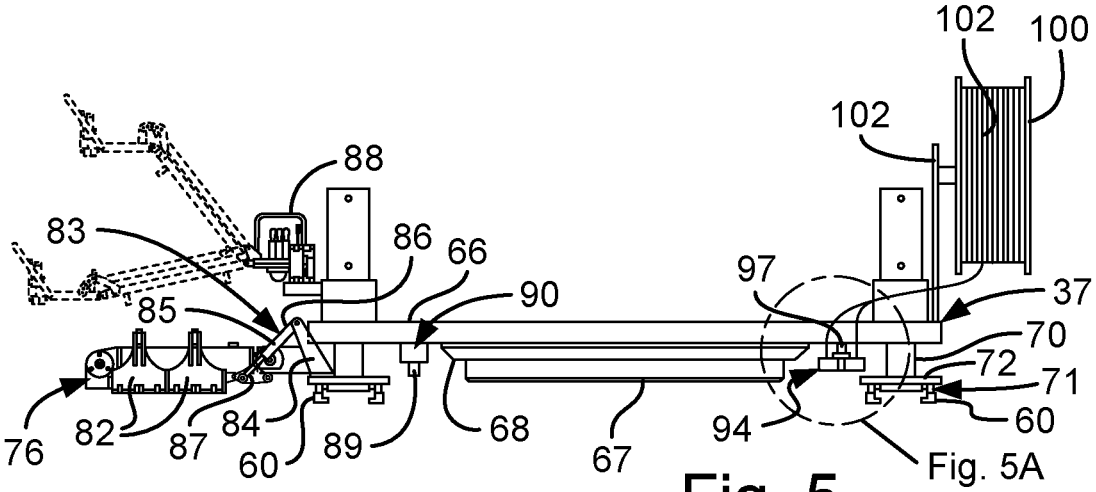
FIG. 5 is a side schematic view of a spider skid for moving a spider.
Figure 5A:
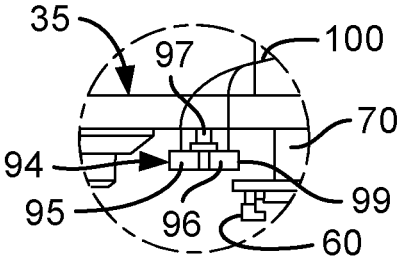
FIG. 5A is an enlarged view of part of the spider skid shown in FIG. 5.
Figure 6:
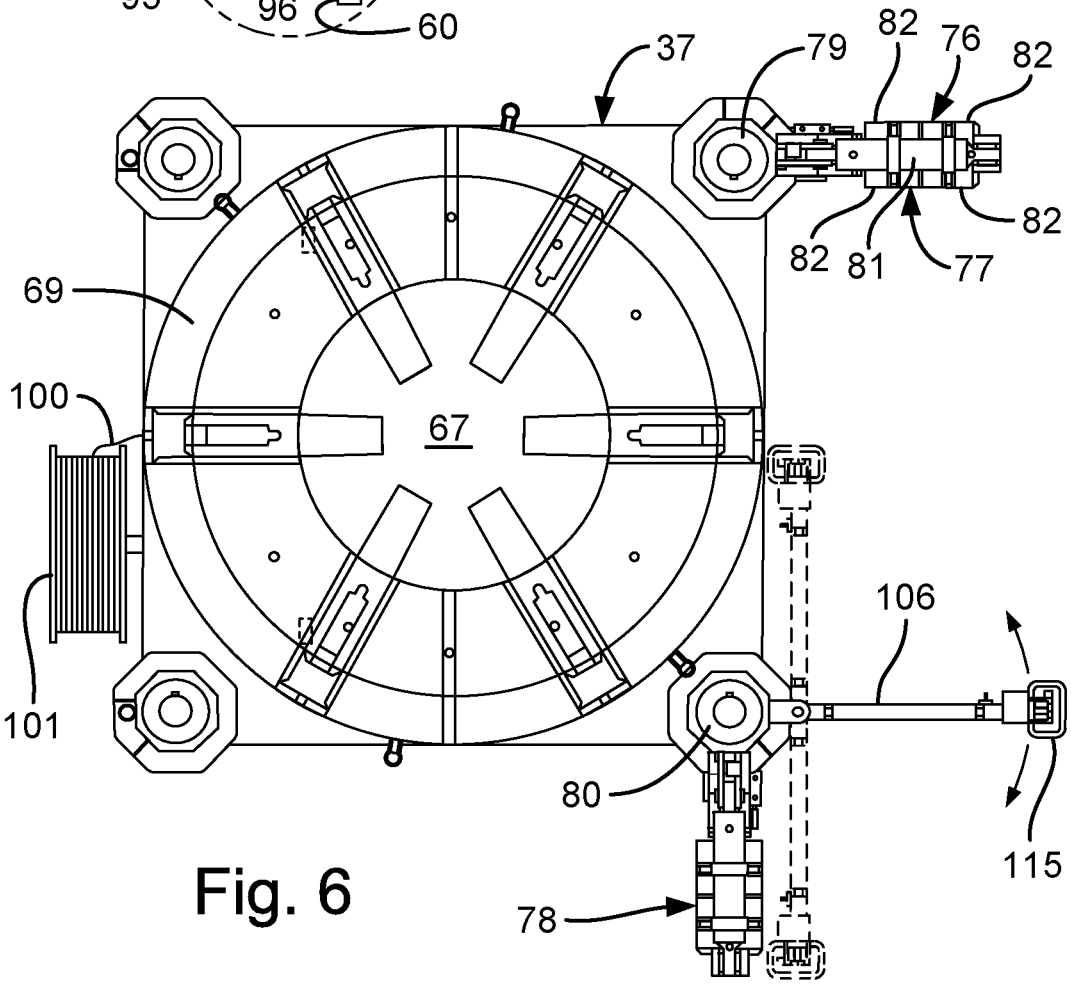
FIG. 6 is a top plan view of the spider skid shown in FIG. 5 with a spider thereon.

FIG. 5 shows one type of item skid, a spider skid 37. The spider skid 37 comprises a square base plate 66 having sides approximately 3.4 m in length, with a circular opening 67 therein and a depression 68 about the circular opening 67 sized to fit a spider 69. The square base plate 66 has a shoe 60 at each corner, such that the distance between shoe centres is 3.2 m. A stub leg 70 is arranged between each corner of the square base plate 66 and the shoe 60. The shoe comprises a slider 71 having a top plate 72 sized to sit on top of the rail top 59, a skirt portion 73 to fit over sides of the rail top 59 and a hook portions 74 for fitting under the rail top 59 and above the shoulders 58. The top plate 72, the skirt portion 73 and the hook portion 74 define a channel 75. A corresponding perpendicular channel (not shown) is also provided in each shoe, such that the spider skid 37 can ride along track 51, rails 53, 54 run through the pair of channels 75 and when the spider skid 39 takes track 52, the rails 55, 56 run through the corresponding perpendicular channels.

The spider skid 37 is propelled along the network of rails 10 by a propulsion system 76. The propulsion system 76 comprises a first foot 77 arranged in line with one channel 75 and arranged at a first corner 79 and a second foot 78 in line with one of the corresponding perpendicular channels (not shown) at a second corner 80. The first and second feet 77, 78 have a sole plate 81 and four selectively actuatable side grippers 82. The first and second feet 77, 78 are each provided with a movement arm 83 which each has a rigid member 84 and a hydraulic ram 85. The hydraulic ram 85 is of the double acting type. The first rigid member 84 at a proximal end is welded or otherwise fixed to the respective top plates 72 of first and second foot 77, 78 and at a distal end pinned to a cylinder end 86 of hydraulic ram 85 and a piston end 87 of the hydraulic ram is pinned to the sole plate 81. An on-board control system 88 controls flow of hydraulic fluid to the propulsion system 76.

In use, flow of hydraulic fluid to the propulsion system 76 is controlled by the on-board control system 88. The propulsion system 76 can operate in a pull or push mode and in a first direction or a perpendicular second direction. In push mode in a first direction, the hydraulic ram 85 is initially contracted and the sole plate 81 lies on a rail, such as rail 53 with the selectively actuatable side grippers 82 in an open position in which they do not touch the sides of the rails 53 and lie in a plane above the rail 53. The on-board control system 88 sends a flow of hydraulic fluid to the selectively actuatable side grippers 82 to move to a closed position in which they move downwardly and inwardly to grip the rail 53. The on-board control system sends a further flow of hydraulic fluid to the hydraulic ram 85 to extend. The spider skid 37 is pushed along rail 53 and evenly along the track 51. The selectively actuatable side grippers 82 are then released by flow of hydraulic fluid controlled by the on-board control system 88, the hydraulic ram 85 is contracted by flow of hydraulic fluid controlled by the on-board control system 88, whereupon the sole plate 81 of the first foot 77 slides along the top of the rail 53 toward the square base plate 66. These steps are repeated to cycle the foot 77 to push the spider skid in a first direction. It should be noted that the second foot 78 is not operated in this mode of operation. When the spider skid 37 reaches an intersection, t-junction or corner, the second foot in operated to push or pull the spider skid 37 therealong. For pull mode the cycle is reversed. The spider skid can travel at a speed of between 0.3 and 3 m/min.

The spider skid 37 has a parking system 90. When the spider skid is close to a predetermined parking spot, a locating pin 89 of a locating pin mechanism 90 on an underside of the square base plate 66 is activated by master control system 105, which lowers a pin on a pin ram 89', as shown in FIGS. 7A and 7B. The parking system 90 is located centrally along one end of the square base plate 66. The locating pin 89 is now resiliently biased downwardly against the rig floor 2 by a resilient means, such as a spring 89". The spider skid 37 continues under its self-propulsion until the locating pin 88 passes over a locating hole 91, at which point the spring biases the locating pin 88 into the locating hole 91. The control system 88 ceases the flow of hydraulic fluid to the propulsion system 76, which stops the spider skid 37 from further movement. The four selectively actuatable side grippers 82 are actuated to grip the rail 53 to act as a hand brake. Alternatively or additionally, the parking system 90 may also act as a hand brake to inhibit the spider skid 37 from moving.

A combined hydraulic fluid supply hose and communication lines 100 are provided between the rig floor 2 and the spider skid 37. Hydraulic hook-up points 92 and communication line hook-up points 93 are provided in the rig floor 2 between the rails and approximately 2.8 metres behind each locating hole 91. The hydraulic hook-up point 92 is connected to a pressurized hydraulic fluid supply (not shown), which is a common feature of all drilling rigs and drill ships. The communication line hook-up point 93 is connected to the master control computer system 105 of the drilling rig. The spider skid 37 is also provided with an automatic hook-up system. A corresponding hook-up connector mechanism 94 is provided on an opposing end of the square base plate 66 to the parking mechanism 90, approximately 2.8 m apart. The corresponding hook-up connector mechanism 94 has connector block 99 comprising a hydraulic connector 95 and a communication line connector 96 which is arranged beneath a small self-powered ram 97. The combined hydraulic fluid supply hose and communication lines 100 are fixedly connected to a top of the connector block 99. The combined hydraulic fluid supply hose and communication lines 100 is wound around a self-powered reel 101 which has a rewind mechanism (not shown), which may simply by a spring, such that when the combined hydraulic fluid supply hose and communication lines 100 is uncoiled, the spring is energised. The reel 101 is mounted on a mounting structure 102. The combined hydraulic fluid supply hose and communication lines 100 is between five and thirty metres long and most optionally between ten and twenty metres long.

Figure 7:
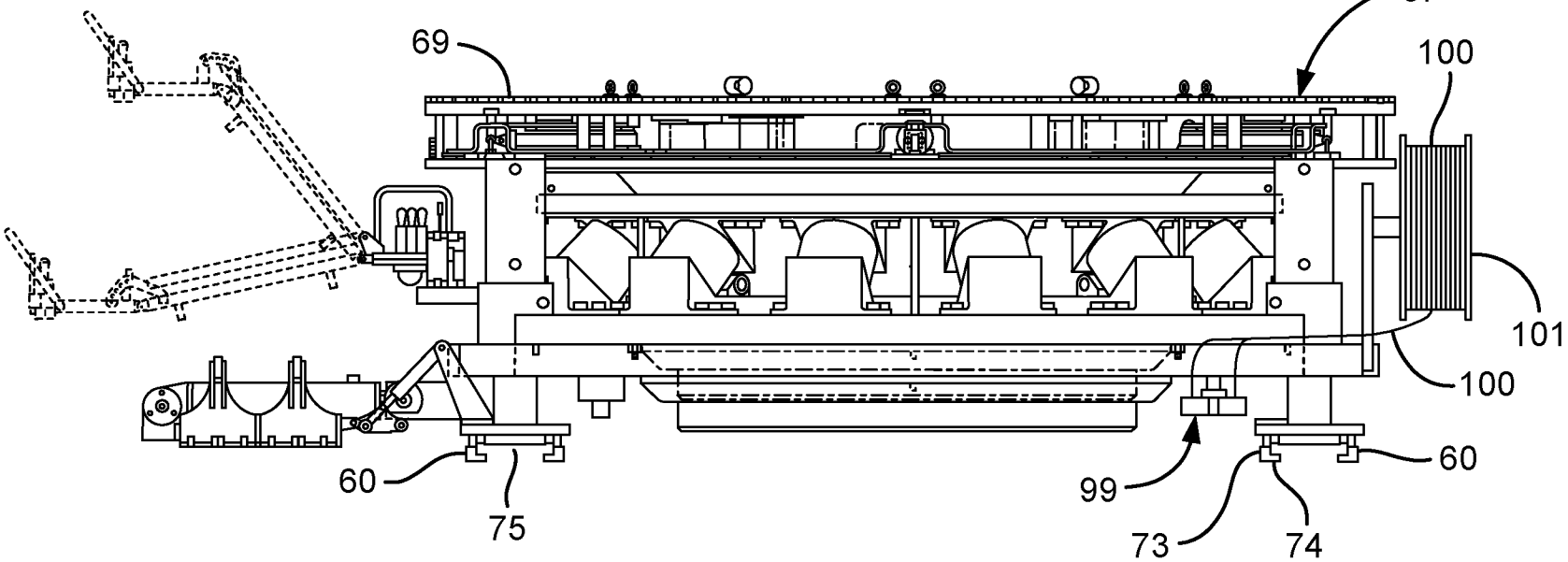
FIG. 7 is a side schematic view of the spider skid shown in FIG. 5 with a spider thereon.
Figure 7A:
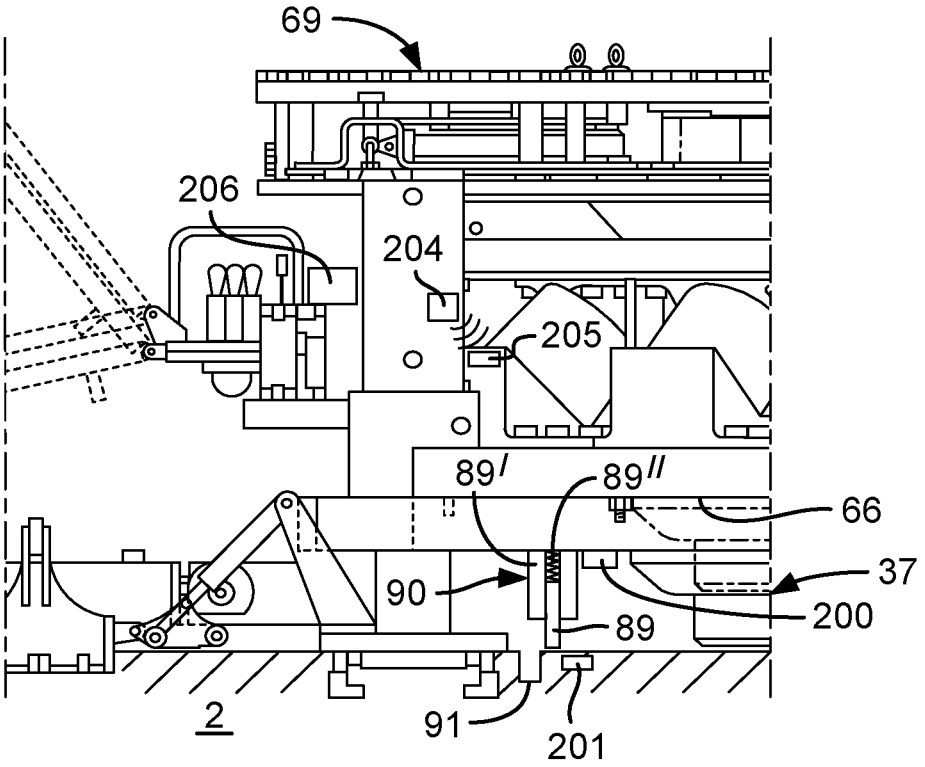
FIG. 7A shows a part of the spider and spider skid shown in FIG. 5 in a first position of use on a rig floor during movement towards a parking point (with rails not shown for clarity)
Figure 7B:
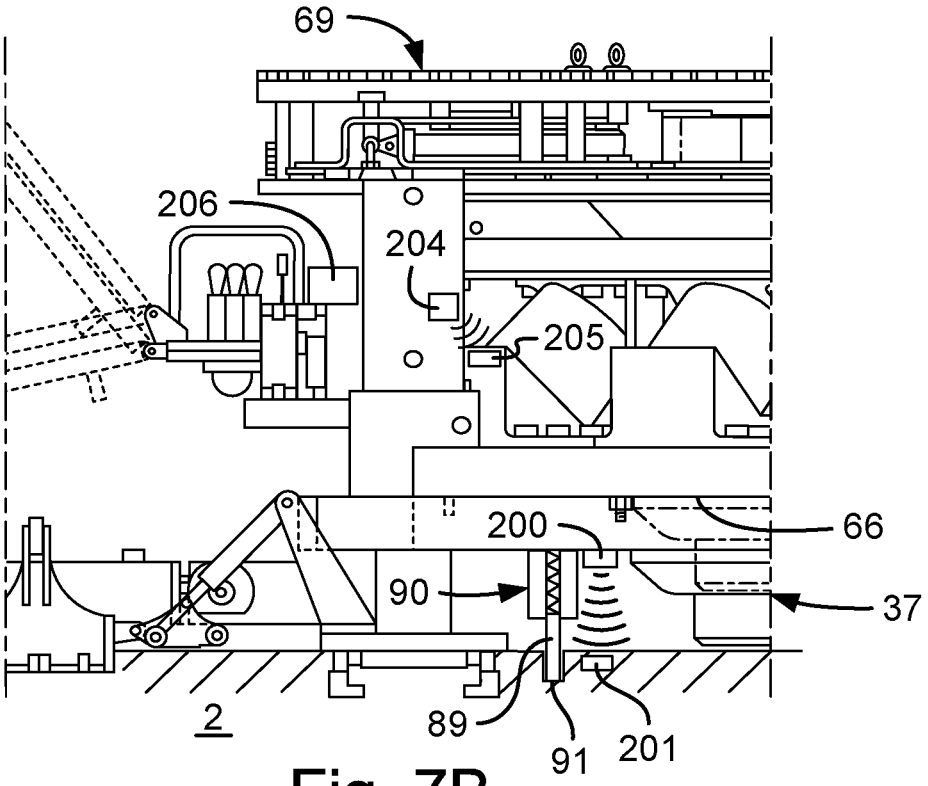
FIG. 7B shows a part of the spider and spider skid shown in FIG. 5 in a parked position (with rails not shown for clarity)

In use, when the spider skid 37 is parked, the self-powered rewind reel 101 is activated to reel in the combined hydraulic fluid supply hose and communication lines 100 until the connector block 99 returns to the position shown in FIGS. 5 and 7. The small self-powered ram 97 is then activated to extend. An optional cover 103 over hook-up points 92 and 93 may be provided, which automatically opens upon the locating pin 89 inserting into locating hole 91. The small self-powered ram 97 pushes the connector block 99 on to hook-up points 92 and 93, providing the spider skid with a pressurized flow of hydraulic fluid and communication channels between the spider skid 37 and a master control computer system 105 on the drill ship 1.

The pin ram 89" is retracted to retract pin 89 from engagement with the locating hole 91 and from contact with the rig floor 2, when the spider skid 37 begins to move.

A manual control interface 115 is provided on an arm 116 movably pinned to the square base plate 66. The manual control interface 115 may be used in place of being controlled from the master control computer system 105.

Before the spider is needed a command is sent to operatives in the workshop to prepare the spider skid 37. The spider 69 is placed on the spider skid 37 in the workshop 42. The spider skid 37 will travel up on the skid elevator 41 along tracks 13 and parked in the buffer storage area 40.

Figure 7C:
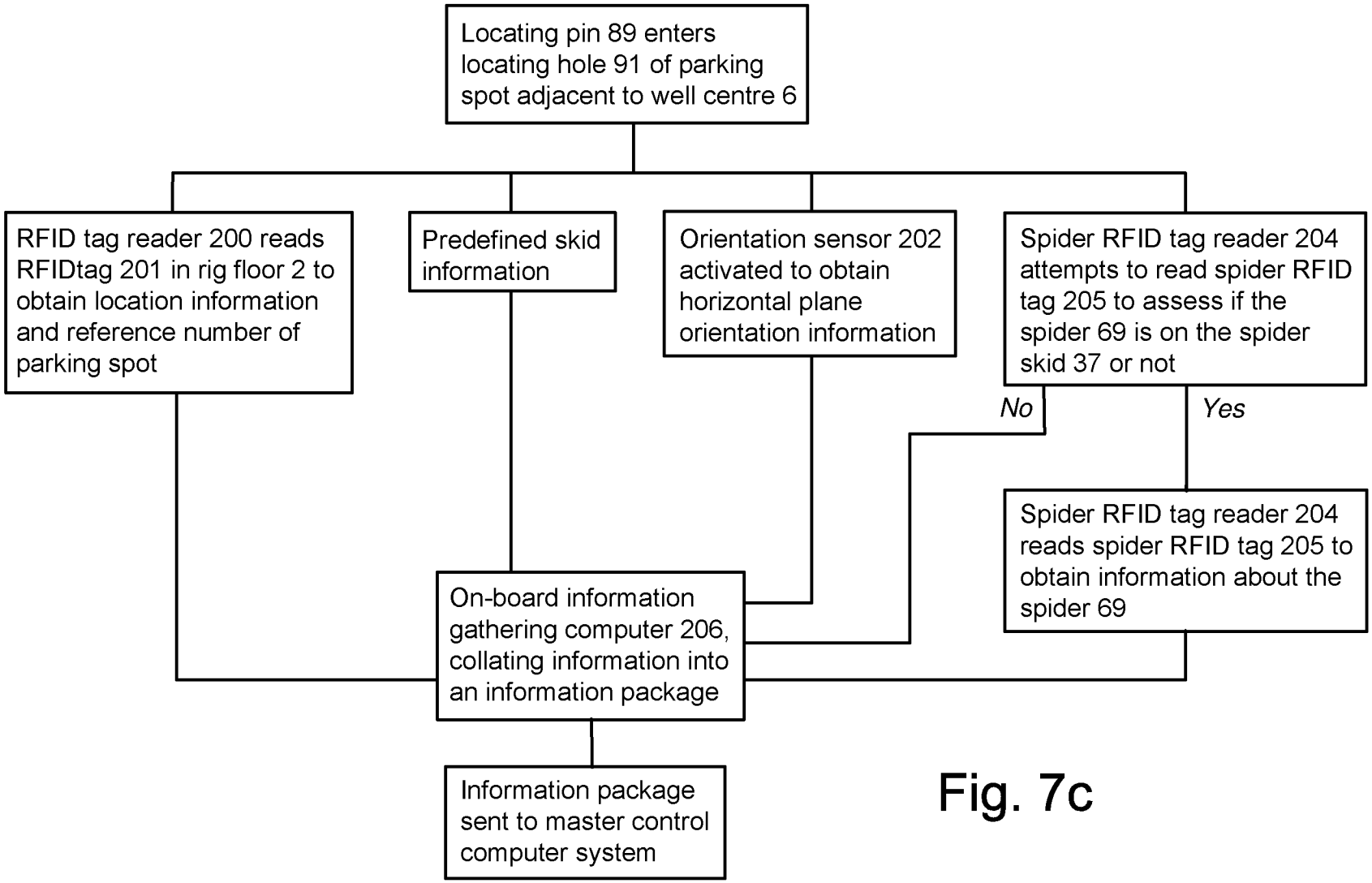
FIG. 7C shows a flow diagram of a control system in accordance with the invention.

Referring to FIG. 7C, an information package is collated by an on-board information gathering computer 206. A parking RFID tag reader 200 arranged on the underside of base plate 66 adjacent the parking mechanism 90. The RFID tag reader is activated by the on-board information gathering computer 206 to read parking spot information from RFID tag 201 in the rig floor 2. The RFID tag 201 reader sends a parking spot information package, such as location and a reference number to the on-board information gathering computer 206. A spider RFID tag reader 204 is activated by the on-board information gathering computer 206 to read spider information from RFID tag 205. If there is no RFID tag 205 to read, then an on-board information package is sent to the on-board information gathering computer 206 indicating that no spider 69 is aboard the spider skid 37. A further weight sensor arranged on the base plate 66 and linked to the on-board information gathering computer 206 may be used to check this is the case. If the RFID tag reader 204 is able to read the RFID tag 205, the information relating to the spider 69 is sent to the on-board information gathering computer 206 as a spider information package. Such spider information package may include data about the type of pipe it is suitable for use with, size, and any faults it may have or have had and subsequent rectifications. An orientation information package such as orientation of the skid may also be obtained by the on-board information gathering computer 206 from an orientation sensor (not shown). A storage memory, such as RAM or EPROM (not shown) is also arranged on the spider skid containing a spider skid information package, which contains information such as a reference number and a description stating that it is a spider skid. The spider skid information package, orientation information package, spider information package, on-board information package, and parking spot information are collated into a skid information package the on-board information gathering computer 206 and sent to the master control computer system 105.

The master control system 105 is provided with a pre-programmed arrangement for setting a spider at well-centre. The master control system 105 also has skid information packages from every skid on the network of rails. The master control system 105 automatically sends the spider skid to its destination when required. For instance, the driller can press an "install drill pipe spider in first well-centre" button at a visual interface (not shown) of the master control system from the dog house skid 31. The destination will be on track 16 at one of the well-centres 6 or 7. The master control computer system 105 controls the spider skid 37 to withdraw locating pin 89 from locating hole 91 and then activate the on-board control system 88 to control the propulsion system 76, so that the spider skid 37 can move to its destination. From the storage area 40, the spider skid propels itself to track 16 to a predetermined parking spot next to well-centre. Simultaneously, a crane skid 36 (shown in FIGS. 11 to 13) is sent from buffer storage area 40 to a predetermined parking spot of track close to well-centre. The crane skid has the same self-propelling system, parking system, automatic hook-up system and automatic control system as described with reference to the spider skid 37. It should be noted that the reel of the automatic hook-up system are not shown in FIGS. 11 to 13 for clarity. The crane skid 36 is parked on track 17 at the predetermined parking spot using a parking mechanism (not shown), which is identical to the parking mechanism 90 shown and described with reference to the spider skid 37. A crane 112 on crane skid 36 is then operated from a remote location, such as from the dog house skid 31, using fly-by-wire control system (not shown) to activate hydraulic valves in the crane 112, or can be operated in automatic mode by the master control computer system 105. The computer system 105 knows the absolute location of the crane skid 36 and the spider skid 37. In automatic mode, a jib 116 is raised using ram 118 and extended using ram 119 over the spider 69 in the spider skid 37. A hook 117 is lowered on line 120 over the spider 69 and under a hook receiver of the spider (not shown). The hook 117 raised on line 120. The crane is rotated on rotating table 121 and lowered into well-centre. Alternatively, the master control system 105 controls the spider skid 37 to travel over the required well-centre 6 or 7. The spider 69 can be lifted from the spider skid 37 using a hook (not shown) depending from a top drive 106, 107 (see FIG. 20) in the derrick 4 or 5. The spider skid 37 is then moved along track 16 and then the top drive 106, 107 is lowered by a drawworks 111 via a line 108, (not shown) which passes over a crown block 109, 110 at the top of the derrick 4, 5. The spider 69 is thus lowered into the rig floor 2 at well-centre 6, 7. Hydraulic power and communication lines for the crane 112 is provided through an auxiliary line (not shown) on the crane skid 36, which branches from the combined hydraulic fluid supply hose and communication lines 100. Thus an additional hook-up is not required. The dog house skid 31 shown in FIGS. 1 to 3 comprises a cabin 47, arranged on a skid 48 incorporating the same self-propelling system, parking system, automatic hook-up system and automatic control system as herein described with reference to spider skid 37. Although, a manual hook-up system may be used, as with reference to the BOP test stump skid 39 described below. A rotating base 49 is arranged between the skid and the cabin 47 to allow the cabin 47 to rotate relative to the skid 48 to facilitate the driller and tool pusher to obtain the best view of the rig floor 2, including the well-centres 6 and 7. The dog house 31 has transparent glass sides and a transparent glass roof to facilitate the driller and tool pusher to obtain the best view of the rig floor 2.

Figure 8:
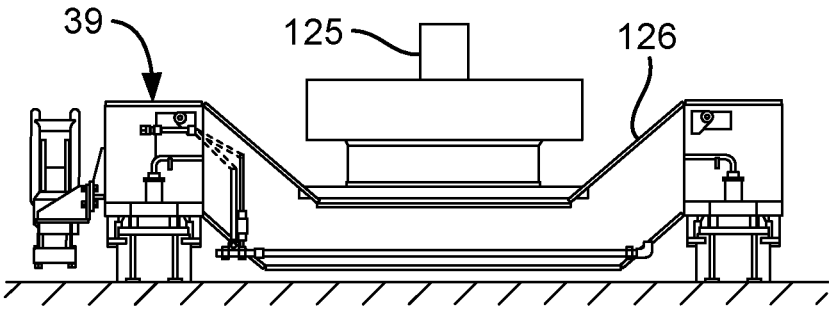
FIG. 8 is an end view of a BOP test stump skid with a BOP test stump thereon.
Figure 9:
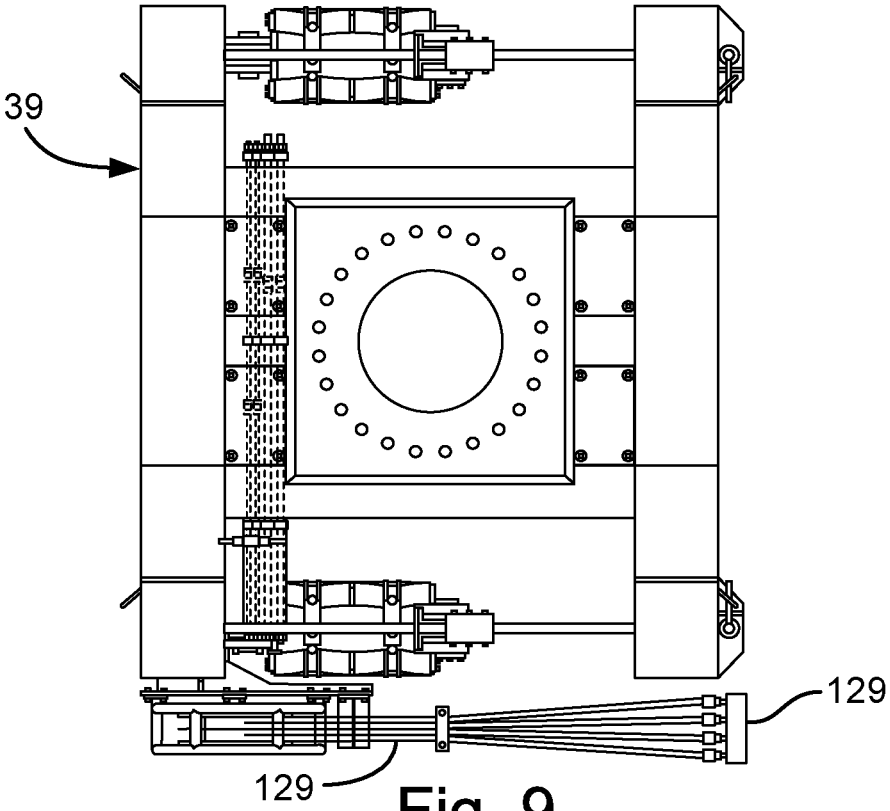
FIG. 9 is a top plan view of the BOP test stump skid show in FIG. 8 with the test stump thereon.
Figure 10:
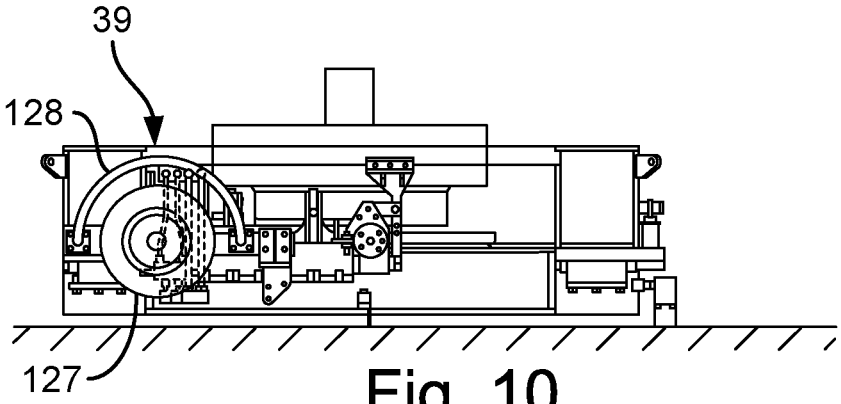
FIG. 10 is a side view of the BOP test stump skid shown in FIG. 8 with the BOP test stump thereon.

A BOP test stump skid 39 is shown in FIGS. 8 to 10 with a BOP test stump 125 thereon. The BOP test stump skid 39 is generally similar to the spider skid 37 described above, save for the following differences. A base plate 126 is formed to support the BOP test stump 125. A reel 127 for a combined hydraulic fluid supply hose and communication lines 129 is provided with a guard 128 to circum a top portion of the reel 127. The reel is provided with an automatic rewind mechanism, as with reel 101. However, a rig hand manually plugs and unplugs the connector block 129 from hook-up point 92, 93 to hook up point as the skid progresses along the network of rails 10. Feet of the propulsion system are not shown.

Figure 14:
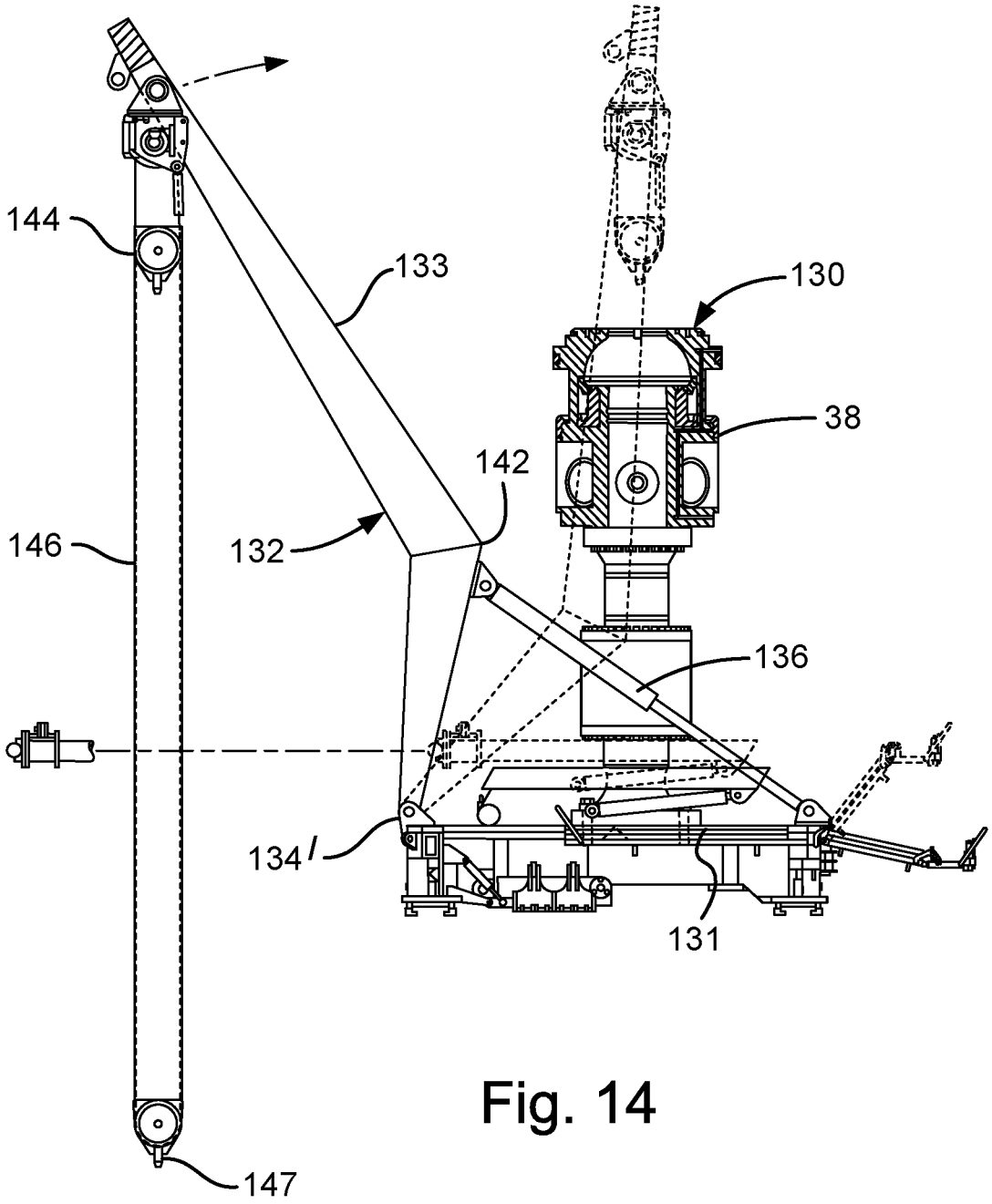
FIG. 14 is a front view of a diverter skid with a diverter supported thereon showing a first and second step of operation.
Figure 15:
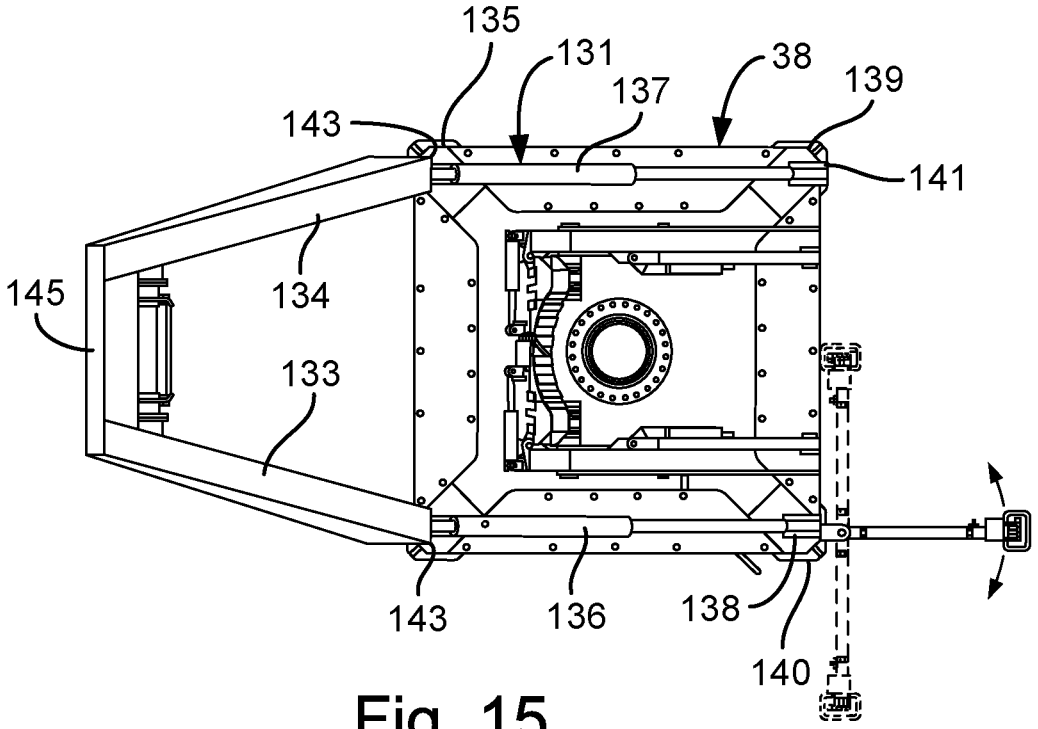
FIG. 15 is a top plan view of the diverter skid with the diverter supported thereon.

A diverter skid 38 is shown in FIGS. 14 and 15 having a diverter 130 thereon. The diverter skid 38 is provided with the same self-propelling system, parking system, automatic hook-up system and automatic control system described with reference to the spider skid 37, although may have the manual hook-up system described with reference to the BOP test stump skid 39. The diverter skid 38 is thus generally similar to the spider skid 37, save for the following differences. The diverter skid has a generally planar base plate 131 and a lifting arm mechanism 132. The lifting arm mechanism 132 comprises a pair of rigid kinked arms 133 and 134 approximately 6 metres long each pivotally attached at a lower end to a lug 134' and (not shown) welded to adjacent front corners 134' and 135 of the base plate 131. A ram 136 and 137 is pivotally arranged between lugs 138 and 139 welded to adjacent rear corners 140 and 141 of the base plate 131 and elbows 142 and 143 of the rigid kinked arms 133 and 134. A powered crown block 144 is hung from a top bar 145 linking tops of the rigid kinked arms 133 and 134. A line 146 runs between the powered crown block 144 and a small travelling block 146 having a connector 147.

In use, the master control system 105 automatically sends the diverter skid 38 to its destination when required. For instance, the driller can press an "install diverter in first well-centre" button at a visual interface (not shown) of the master control system from the dog house skid 31. The destination will be on track 16 at one of the well-centres 6 or 7. The master control computer system 105 controls the diverter skid 38 to activate the parking system to withdraw a locating pin from locating hole 91 and then activate the on-board control system to control the propulsion system, so that the diverter skid 38 can move to its destination. From the storage area 40, the diverter skid 38 propels itself to track 16 to a predetermined parking spot next to well-centre. The lifting arm mechanism 132 is initially arranged in a first position identified in ghost lines in FIG. 14, with rams 136 and 137 in a substantially upright position and with the connector 147 connected to a lifting point (not shown) on the diverter 130. The master control computer system 105: activates the powered crown block 144 to lift the diverter 130 clear of the base 131; extends hydraulic rams 136 and 137 to shift the diverter over well-centre 6; to activate the powered crown block 144 to lower the diverter 130 on to well-centre. Alternatively, the lifting arm mechanism 132 is operated from a remote location, such as from the dog house skid 31, using fly-by-wire control system (not shown) to activate hydraulic valves (not shown) in the lifting arm mechanism 132. Hydraulic power and communication lines for the lifting arm mechanism 132 is provided through an auxiliary line (not shown) on the diverter skid 38, which branches from the combined hydraulic fluid supply hose and communication lines 100. Thus an additional hook-up is not required.

Bare skids may be provided with a simple square planar base plate to move other items around the rig floor 2. Two or more bare skids can operate in unison one behind the other in order to move long or large items. The skid elevator 41 is shown in FIGS. 16 to 19.

Figure 18:
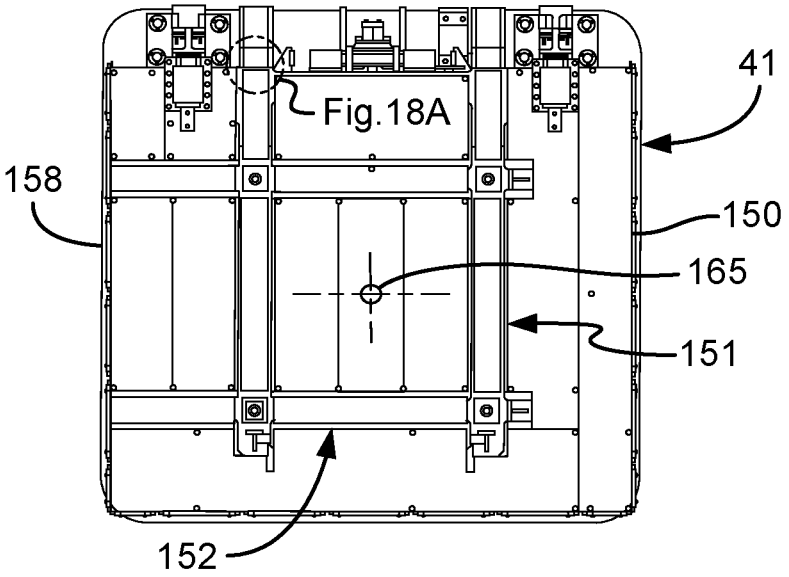
FIG. 18 is a top plan view of the skid elevator platform shown in FIG. 16.
Figure 18A:
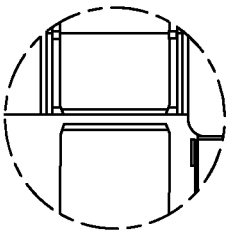
FIG. 18A shows a detail of part of the skid elevator and workshop floor.
Figure 16:
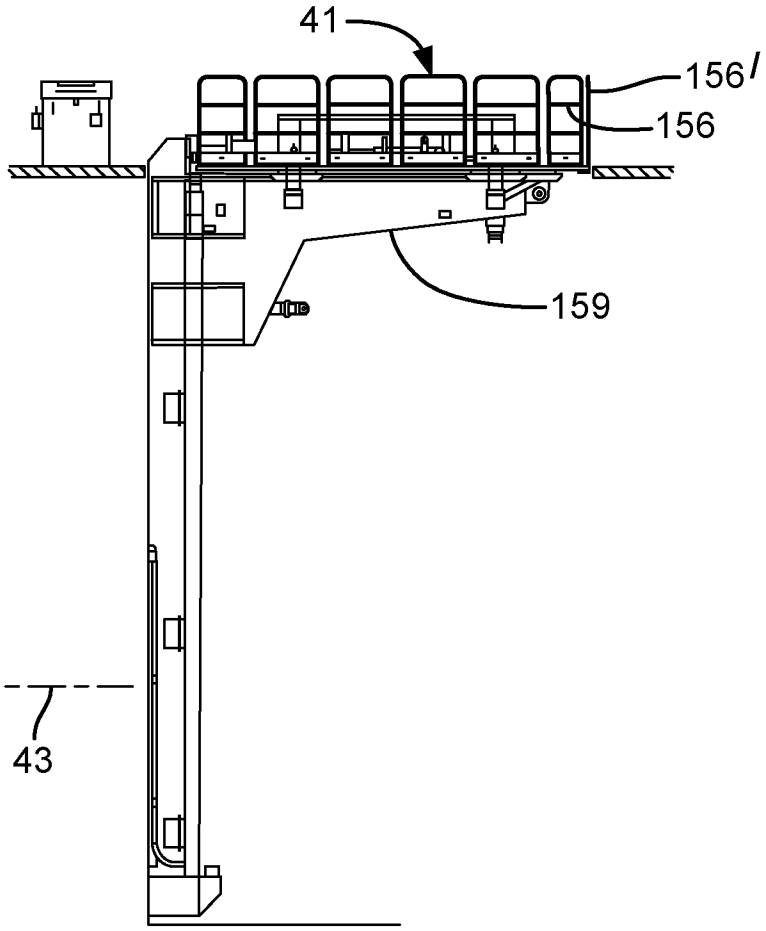
FIG. 16 is a side view of a skid elevator of the network of rails shown in FIG. 4, with a skid elevator platform in a raised position at rig floor level.
Figure 17:
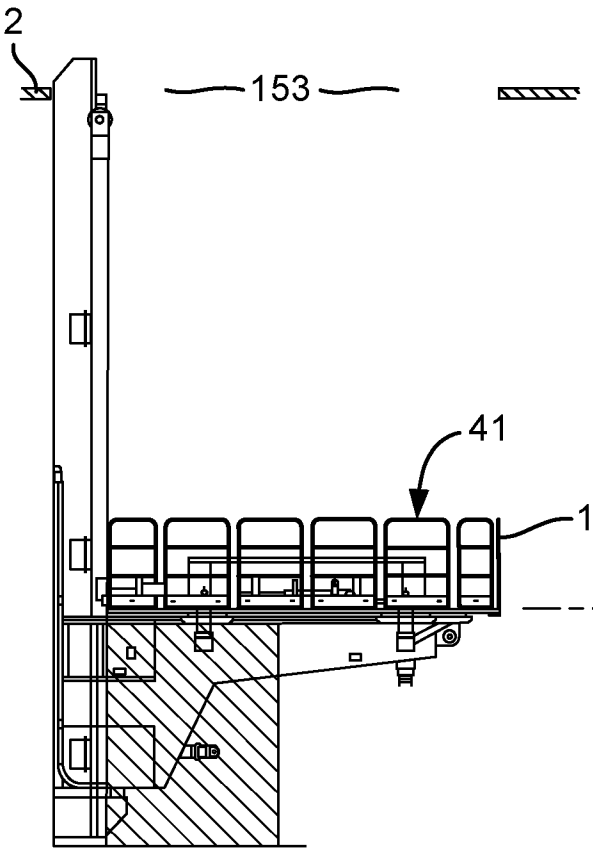
FIG. 17 is a side view of the skid elevator of the network of rails shown in FIG. 16, with the skid elevator platform in a lowered position at workshop floor level.
Figure 19:
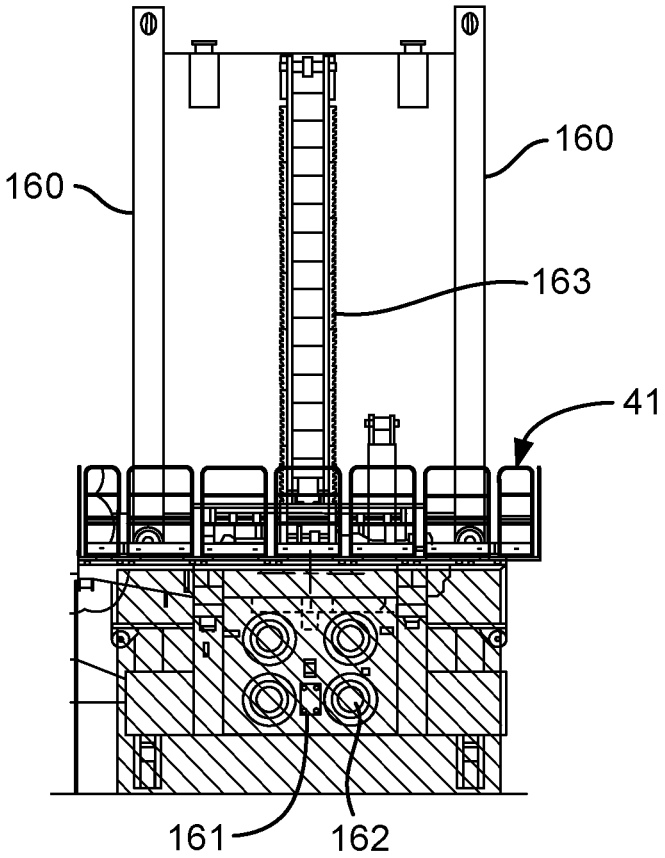
FIG. 19 is a front view of the skid elevator shown in FIG. 16, with the skid elevator platform in a lowered position at workshop floor level.

The skid elevator 41 comprises an elevator floor 150 having a track 151 and a perpendicular track 152 for routing skids on to tracks 13 and 19 on the rig floor 2. A locating hole 165 is provided for facilitating parking a skid on the elevator floor 151. An opening 153 in the rig floor 2 is provided which is substantially the same size as the elevator floor 151, such that when the elevator floor 2 is at the rig floor 2, there is a very small gap of a few millimetres between ends of adjacent rails 154 and 155, as shown in FIG. 18A. Hand rails 156 are provided about the elevator floor 151. Hand rails 156' are provided about the opening 153 in the rig floor 2. Hand rails 156 on sides 157 and 158 slide downwardly when the elevator floor 151 is in line with either of the rig floor 2 or the workshop floor 42, to allow skids wish to pass. The elevator floor 151 is supported by a structure 159 which is slidably arranged on a pair of vertical 160. A motor 161 drives two pairs of toothed wheels 162 along a vertical track 163. Activation of the skid elevator 41 is controlled by the master computer control system 105.

The pipe tail handler skid 30 shown in FIGS. 1 and 2, is provided with the same self-propelling system, parking system, automatic hook-up system and automatic control system described with reference to the spider skid 37, although may have the manual hook-up system described with reference to the BOP test stump skid 39. The pipe tail handler skid 30 is thus generally similar to the spider skid 37, save for the following differences. The base 167 is substantially planar with a vertical rigid column 168 on which is mounted a pipe handler arm 166 having a pipe gripper 169'. The pipe handler arm 166 and pipe gripper 169' are hydraulically actuated and controlled from the master control computer system 105. Hydraulic power and communication lines for the pipe handling arm 166 is provided through an auxiliary line (not shown) on the pipe tail handler skid 30, which branches from the combined hydraulic fluid supply hose and communication lines 100. Thus an additional hook-up is not required.

The riser handling arm skid 32 shown in FIGS. 1 and 3, is provided with the same self-propelling system, parking system, automatic hook-up system and automatic control system described with reference to the spider skid 37, although may have the manual hook-up system described with reference to the BOP test stump skid 39. The riser handling arm skid 32 is thus generally similar to the spider skid 37, save for the following differences. The base 190 is formed in a structural X-shape lying in a horizontal plane with a planar square central portion 191, with a raised platform 192 on which rotatably mounted a horizontal extendible riser handling arm 193 having a riser guide 194. The extendible riser handling arm 193 is hydraulically actuated and controlled from the master control computer system 105. Hydraulic power and communication lines for the extendible riser handling arm 193 is provided through an auxiliary line (not shown) on the riser handling arm skid 32, which branches from the combined hydraulic fluid supply hose and communication lines 100. Thus an additional hook-up is not required.

The coiled tubing skid 34 shown in FIG. 2, is provided with the same self-propelling system, parking system, automatic hook-up system and automatic control system described with reference to the spider skid 37, although may have the manual hook-up system described with reference to the BOP test stump skid 39. The coiled tubing skid 34 is thus generally similar to the spider skid 37, save for the following differences. The base 195 is generally planar, with a drum frame 196 rotatable mounted thereon. The drum frame has a drum 197 mounted therein, with a drum having a horizontal axis. The drum frame 196 is rotatably mounted on the planar base 195, such that the drum frame 196 can rotate about a vertical axis to allow coiled tubing 198 on the drum 197 to be played out perpendicularly to the axis of the drum, no matter where the coiled tubing skid is located on the network of rails 10. The drum 197 has a drive system (not shown) to help winding and rewinding. The drive system may be hydraulically actuated and controlled from the master control computer system 105. Hydraulic power and communication lines for the drive system is provided through an auxiliary line (not shown) on the coiled tubing skid 34, which branches from the combined hydraulic fluid supply hose and communication lines 100. Thus an additional hook-up is not required.

Figure 21:
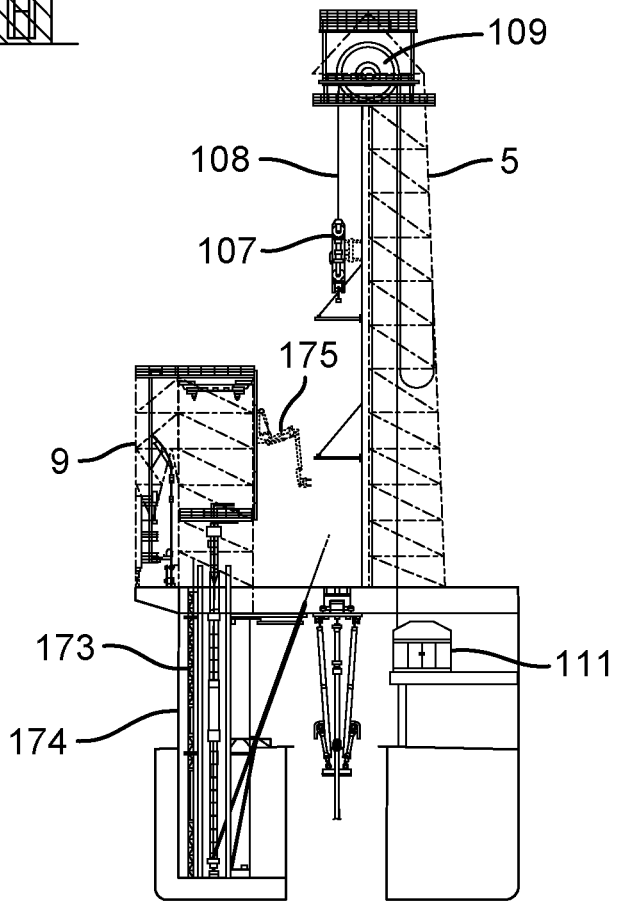
FIG. 21 shows a schematic side view in cross-section of the drill ship shown in FIG. 4 taken along line XXI-XXI.
Figure 20:
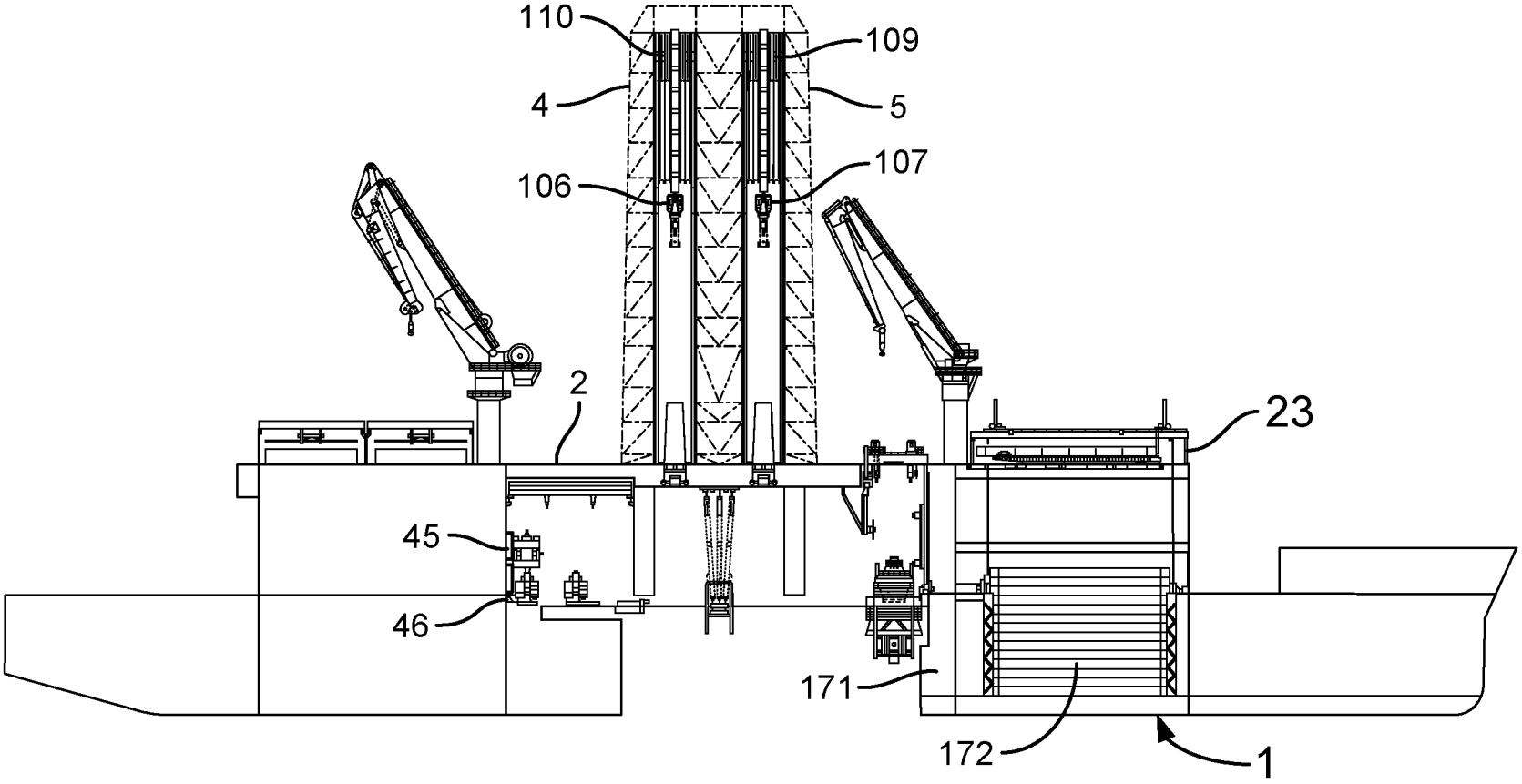
FIG. 20 shows a schematic side view in cross-section of the drill ship shown in FIG. 4 taken along line XX-XX.

FIGS. 20 and 21 shows parts of the drill ship 1. The drill ship 1 has large cranes 170 which are used for loading and off-loading equipment on to a dock side. They are also used for handling equipment around the rig floor 2. There is a forward hold 171 for sections of riser 172. A pipe handling and make-up structure 9 provides an area to make-up joints of drill pipe into stands 173 which are set back in a hold 174. A pipe handling arm 175 facilitates manipulation of the stands of drill pipe from the hold 174 to the well-centre 6 or 7.

The network of rails 10 comprises track 11 to 19 in a layout which will be suitable for a rig floor on a dual derrick drill ship. A layout for other types of rigs such as a single derrick drill ship will be very similar although will have fewer track. A layout for an FPSO having a double derrick will be the same or very similar. A layout for offshore platform having a double derrick, SPAR platform, SWATH sea star platform and tensioned leg platform will be the same or very similar. Although, a skilled man will be able to draw up suitable modified layout for each type of rig. The network of rails may be simplified for a land rig, which generally has a much smaller rig floor.

It is envisaged that the hydraulic propulsion system could be replaced by a pneumatic system or a part hydraulic, part pneumatic system. It is also envisaged that the propulsion system could be electrically powered.

It is envisaged that other items could be conveyed and used whilst remaining on the skids of the invention, such as an iron roughneck and continuous circulation tool.

The invention claimed is:

1. A system for moving items on a rig floor, the system comprising a plurality of skids and a network of rails for guiding the plurality of skids, each skid of said plurality of skids for supporting an item, and each skid of said plurality of skids having a plurality of skid shoes engaging at least one rail of said network of rails, wherein the network of rails comprises at least one predetermined parking spot, and wherein the system further comprises a master computer control system, a parking sensor for obtaining parking location information to indicate that a first skid of said plurality of skids is parked at the predetermined parking spot and relaying the parking location information to the master computer control system, and an item sensor for identifying if the item is present aboard the first skid and relaying the item presence information to the master computer control system.

2. A system as claimed in claim 1, wherein each skid of said plurality of skids comprises at least one cycling foot for propelling a respective skid of said plurality of skids along said network of rails.

3. A system as claimed in claim 1, wherein each skid of said plurality of skids comprises two cycling feet arranged perpendicularly to one another.

4. A system as claimed in claim 1, wherein each skid of said plurality of skids comprises a single cycling foot for propelling the respective skid of said plurality of skids along the network of rails.

5. A system as claimed in claim 2, wherein said at least one cycling foot comprises a gripping mechanism which selectively grips and releases a rail of the network of rails.

6. A system as claimed in claim 2, wherein said at least one cycling foot is powered hydraulically.

7. A system as claimed in claim 6, wherein each skid of said plurality of skids comprises a trailing hydraulic line for powering the at least one cycling foot.

8. A system as claimed in claim 7, wherein each skid of said plurality of skids comprises a reel of hydraulic hose.

9. A system as claimed in claim 8, wherein the rig floor comprises a plurality of hydraulic hook-up supply points.

10. A system as claimed in claim 9, wherein said hydraulic hose has one end provided with a connector, each skid of said plurality of skids comprising a moving apparatus for pushing the connector into one of said hydraulic hook-up supply points.

11. A system as claimed in claim 2, further comprising a propulsion control computer for controlling the at least one cycling foot.

12. A system as claimed in claim 1, wherein said network of rails is arranged in a grid, forming a grid of rails.

13. A system as claimed in claim 12, wherein the network of rails comprises a pair of parallel rails on which said plurality of skids are guided.

14. A system as claimed in claim 12, wherein said grid of rails comprises intersecting warp rails and weft rails and a gap in one of the warp rails and a gap in one of the weft rails at an intersection.

15. A system as claimed in claim 14, wherein at least one of said plurality of skid shoes comprises a skirt portion defining a longitudinal channel and a transverse channel.

16. A system as claimed in claim 1, wherein said predetermined parking spot comprises the rig floor having one of a locating pin and a locating hole at a predetermined parking point and wherein at least one of the plurality of skids has the other of the locating pin and the locating hole, such that in use, one of the locating pin and the locating hole is moved to locate the locating pin in the locating hole.

17. A system as claimed in claim 1, further comprising an ID tag in said rig floor and said parking sensor is an ID tag reader for reading said ID tag in said rig floor.

18. A system as claimed in claim 1, further comprising a memory for storing skid identifier information and relaying the skid identifier information from said first skid to said master computer control system.

19. A system as claimed in claim 1, further comprising an item information sensor for reading information about the item and relaying the item information to the master computer control system.

20. A system as claimed in claim 19, further comprising an ID tag on said item and said item information sensor is an ID tag reader for reading said ID tag in said rig floor, the ID tag containing information about the item.

21. A system as claimed in claim 1, further comprising a skid orientation sensor and relaying skid orientation information to the master computer control system.

22. A system as claimed in claim 1, wherein the network of rails comprises a vertically movable section of rail.

23. A system as claimed in claim 2, wherein the rig floor is located in one of: a drill ship; FPSO; offshore platform; and land rig.

24. A system as claimed in claim 1, further comprising:

a memory for storing skid identifier information and relaying the skid identifier information from the first skid to said master computer control system;

an item information sensor for reading information about the item and relaying the item information to the master computer control system; and a skid orientation sensor for relaying skid orientation information to the master computer control system.

25. A system as claimed in claim 24, wherein at least two of said parking location information, item presence information, item information, and skid orientation information is collated by an on board information gathering computer, placed in a package and sent as an information package to said master control computer system.

26. A system as claimed in claim 25, wherein the master computer control system receives said information packages for all of the plurality of skids on the network of rails.

27. A system as claimed in claim 26, wherein the master computer control system is programmed with information about the layout of tools and equipment for various standard operations, and displaying a list of standard operations for a driller or tool pusher to choose from.

28. A system as claimed in claim 27, wherein the master computer control system controls all of the plurality of skids using the information packages.

29. A system as claimed in claim 28, wherein the master computer control system controls movement of a predetermined selection of skids of said plurality of skids to produce and the layout of tools and equipment for carrying out an operation specified by the driller or tool pusher.

30. A system as claimed in claim 27, wherein the standard operation is taken from a list comprising:

drilling; tripping; casing; completion; and workover.

31. A method of configuring items on a rig floor, wherein a plurality of skids, a network of rails for guiding the plurality of skids, a master computer control system, a parking sensor, and an item sensor are provided, each skid of said plurality of skids comprising a plurality of skid shoes engaging at least one rail of said network of rails, wherein said network of rails further comprises at least one predetermined parking spot, the method comprising the steps of moving an item on a skid of said plurality of skids about at least part of the rig floor, obtaining parking location information with said parking sensor to indicate that a first skid of said plurality of skids is parked at said predetermined parking spot, relaying the parking location information to the master computer control system, identifying if the item is present aboard the first skid with said item sensor, and relaying the item presence information to the master computer control system.

32. A system for moving items on a rig floor, the system comprising:

a plurality of skids;

a network of rails for guiding the plurality of skids, each skid of said plurality of skids for supporting an item and comprising a plurality of skid shoes engaging at least one rail of said network of rails, wherein said network of rails comprises at least one predetermined parking spot;

a master computer control system;

a parking sensor for obtaining parking location information to indicate that a first skid of said plurality of skids is parked at said predetermined parking spot and relaying the parking location information to the master computer control system; and memory for storing skid identifier information and relaying the skid identifier information from said first skid to said master computer control system.

33. A method of configuring items on a rig floor, the method comprising:

providing a plurality of skids, a network of rails for guiding the plurality of skids, a master computer control system, and a parking sensor, wherein each skid of the plurality of skids comprises a plurality of skid shoes that engage at least one rail of said network of rails, and wherein said network of rails comprises at least one predetermined parking spot;

moving an item on a first skid of said plurality of skids about at least part of the rig floor on said network of rails;

obtaining parking location information with said parking sensor indicating that the first skid is parked at said predetermined parking spot;

relaying the parking location information to the master computer control system; and relaying skid identifier information from said first skid to said master computer control system.

* * * * *